US007270216B2

(12) United States Patent
Elliott

(10) Patent No.: US 7,270,216 B2
(45) Date of Patent: Sep. 18, 2007

(54) PORTABLE TABLE ASSEMBLY

(76) Inventor: Lee Gordon Elliott, 9216 240th St. SW., Edmonds, WA (US) 98020

( * ) Notice: Subject to any disclaimer, the term of this patent is extended or adjusted under 35 U.S.C. 154(b) by 0 days.

(21) Appl. No.: 10/728,714

(22) Filed: Dec. 4, 2003

(65) Prior Publication Data

US 2004/0159493 A1 Aug. 19, 2004

Related U.S. Application Data

(63) Continuation-in-part of application No. 10/238,845, filed on Sep. 10, 2002, now abandoned.

(60) Provisional application No. 60/322,212, filed on Sep. 10, 2001.

(51) Int. Cl.
*A47B 37/00* (2006.01)
*E06C 7/16* (2006.01)

(52) U.S. Cl. ..... 182/28; 182/222

(58) Field of Classification Search ..... 182/222, 182/223, 119, 121, 28, 21, 30; 248/210, 248/238

See application file for complete search history.

(56) References Cited

U.S. PATENT DOCUMENTS

| | | | | | |
|---|---|---|---|---|---|
| 790,177 | A | * | 5/1905 | Box | 182/30 |
| 1,706,795 | A | * | 3/1929 | Lomo | 182/30 |
| 1,712,110 | A | * | 5/1929 | Hansen | 182/30 |
| 2,069,969 | A | * | 2/1937 | Nelson | 182/121 |
| 2,430,642 | A | * | 11/1947 | Mahaffey | 182/119 |
| 2,990,005 | A | | 6/1961 | Kemph | |
| 3,452,838 | A | | 7/1969 | Gabrielson et al. | |
| 3,494,446 | A | | 2/1970 | Jacobson | |
| 3,503,468 | A | * | 3/1970 | Taylor, Sr. | 182/121 |
| 4,519,476 | A | | 5/1985 | Alimbau Marques et al. | |
| 5,711,400 | A | * | 1/1998 | Tan | 182/119 |

* cited by examiner

*Primary Examiner*—Hugh B. Thompson, II

(74) *Attorney, Agent, or Firm*—Black Lowe and Graham PLLC

(57) ABSTRACT

An assembly of portable platforms is mounted and connected together on a ladder to provide a working platform.

5 Claims, 25 Drawing Sheets

28
.188
(4X .265)
4X .500
(4X .750)
.188

1.000
7.000
28E
Ø.125
THRU
19.000
28
13.000
(20.000±.015)
4X .750 X .265
OBROUND

PORTABLE TABLE ASSEMBLY

PRIORITY CLAIM

This invention claims priority and is a Continuation-in-Part of application Ser. No. 10/238,845 filed Sep. 10, 2002 now abandoned which claims benefit from provisional application Ser. No. 60/322,212 filed Sep. 10, 2001, both of which are hereby incorporated by reference in their entirety herein.

FIELD OF THE INVENTION

This invention relates generally to a portable table and, more specifically, a portable carpenter's table.

BACKGROUND OF THE INVENTION

Construction, of any type, is typically done in a dynamic environment. More specifically, most construction projects are subject to revision or modification during construction. Thus, the carpenters, or other construction persons, must have an ability to perform their job within the dynamic environment. Typical carpentry and other construction projects require an ability to fabricate construction elements at the job site. Often, the job site is at a remote location, or generally in an inconvenient location. There does not exist an inexpensive and reliable system for providing an elevated work surface at a remote site. There are portable tables on the market, but they are generally cumbersome, expensive and require additional equipment or tools at the job site. Also, to minimize unnecessary equipment and clutter, it is advantageous to have tools that can be used for more than one purpose.

Thus, there is a need for an inexpensive portable table that is reliable, accurate and easily integrated into and in part created from the worker's existing stable of tools.

SUMMARY OF THE INVENTION

The preferred embodiment of the invention is comprised of multiple portable platforms that are connected together and mounted on a ladder laid horizontally to provide a working platform or table. The portable platforms in effect adapt the ladder into a working table, thereby repurposing the ladder for dual uses and thus eliminating the need for a separate platform or table to be carried to the jobsite. The ladder may be positioned on the ground to provide a ground-level working height, or alternatively, the ladder may be supported by sawhorses or other supports to elevate the working platform. Alternatively, the working platform is elevated using foldable legs extended from the ladder instead of using sawhorses or other jobsite supports.

The platform units are assembled together and mounted to the ladder into multiple configurations. The assembly platform may accommodate machining tools in a variety of configurations such that the platform is split adjacently on each side of the machining tool, at equal or different lengths, or places the machining tool at the end of the assembled platform units.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1A:
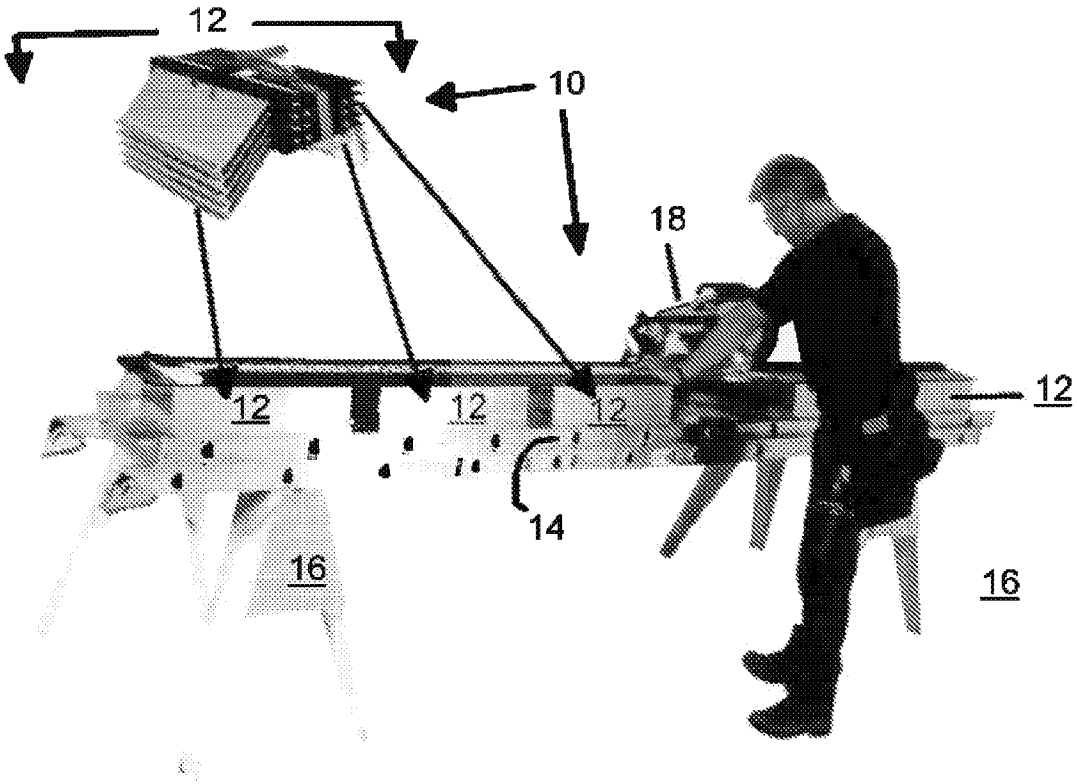
FIG. 1A is a diagram illustrating an exemplary portable table in accordance with the present invention.

FIG. 1A depicts the portable table saw assembly in a detached stack of table units 12, ready for assembly, and the table-assembled units positioned on a ladder 14 supported by saw horses 16. In FIG. 1A a worker operates a chop saw 18 positioned between two of the table units 12.

Figure 1B:
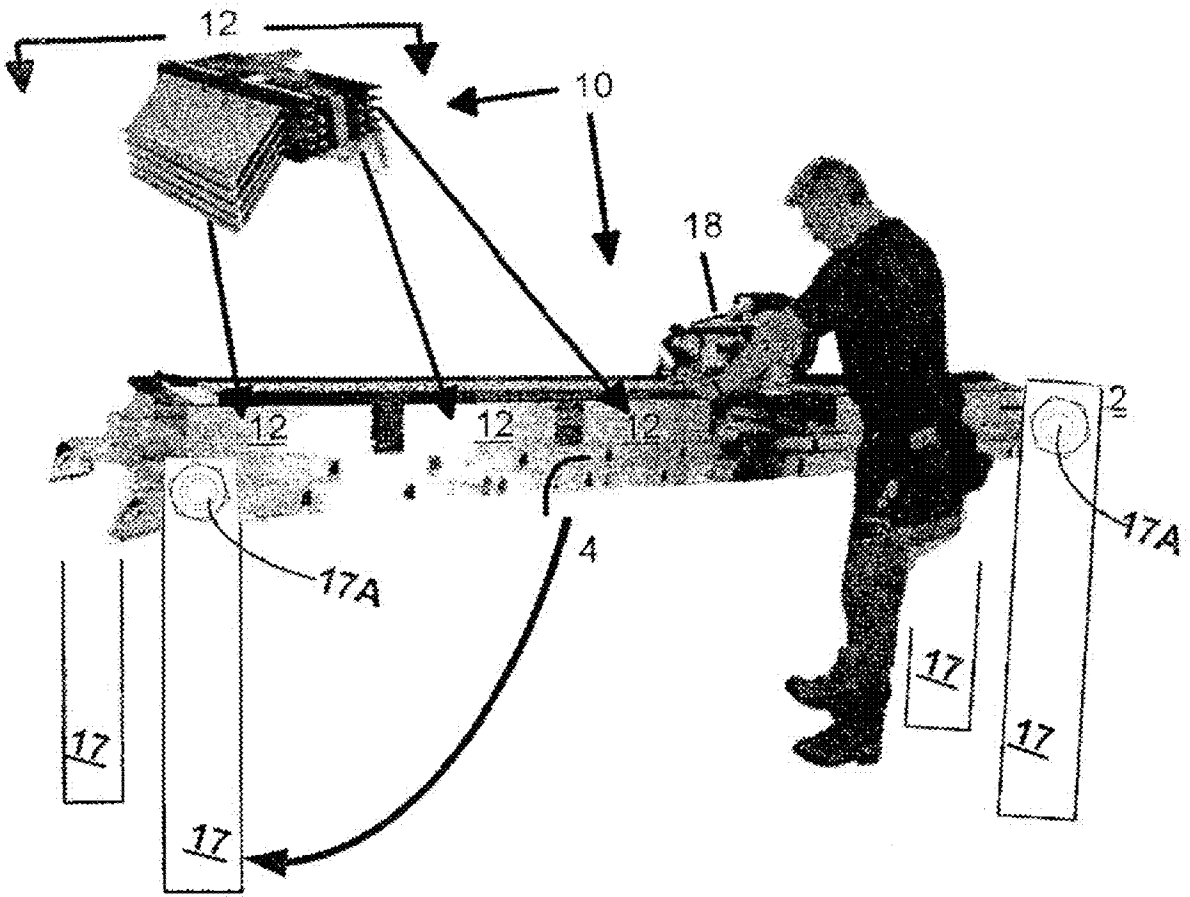
FIG. 1B is a diagram illustrating an exemplary alternate embodiment using a ladder equipped with folding legs.

FIG. 1B depicts the portable table saw assembly in a detached stack of table units 12, ready for assembly, and the table-assembled units positioned on a ladder 14 supported by ladder folding legs 17. In FIG. 1B a worker operates a chop saw 18 positioned between two of the table units 12. Folding legs 17 could be telescoping, locking, one piece, multipiece, or otherwise. Also, legs 17 may be connected to ladder 14 in many alternate ways and places besides the pivoting nut or bolt 17A shown in FIG. 1B. Also, legs 17 may be connectable directly to the underside of table units 12 thereby eliminating any need for hardware or equipment to effect direct attachment to ladder 14. Also, legs 17 may come singly or in pairs. In each variation, they provide an alternate means of support besides the sawhorse. In this way, the carpenter need not carry sawhorses in his truck or van.

Figure 2:
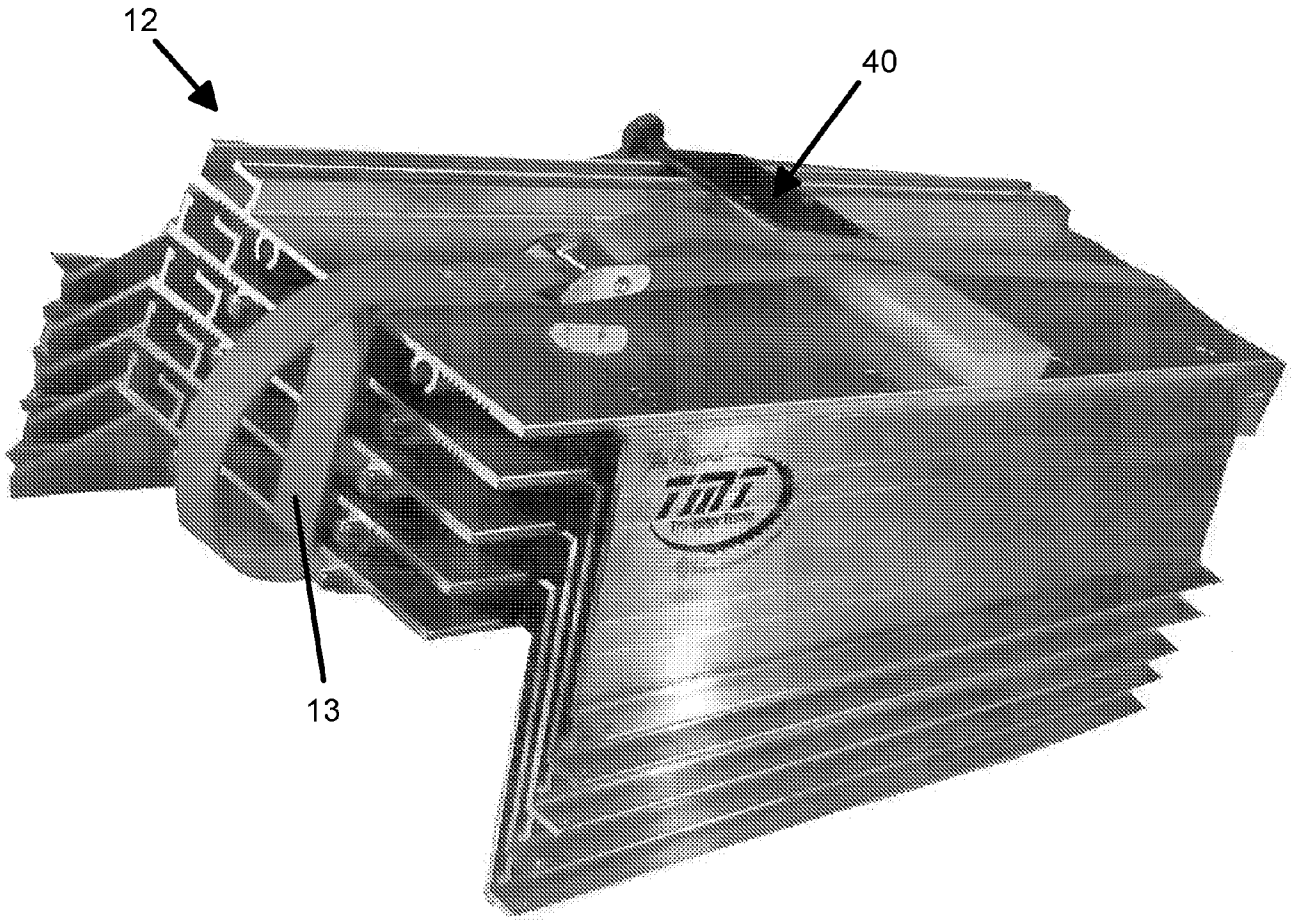
FIG. 2 depicts the components of the detached stack of table units.

FIG. 2 depicts in greater detail the components of the detached stack of table saw units 12. Included with the detached stack is a saw stop 40 and a cinching strap 13. The cinching strap 13 can be easily unbuckled to allow positioning of the table units 12 onto the ladder 14.

Figure 3:
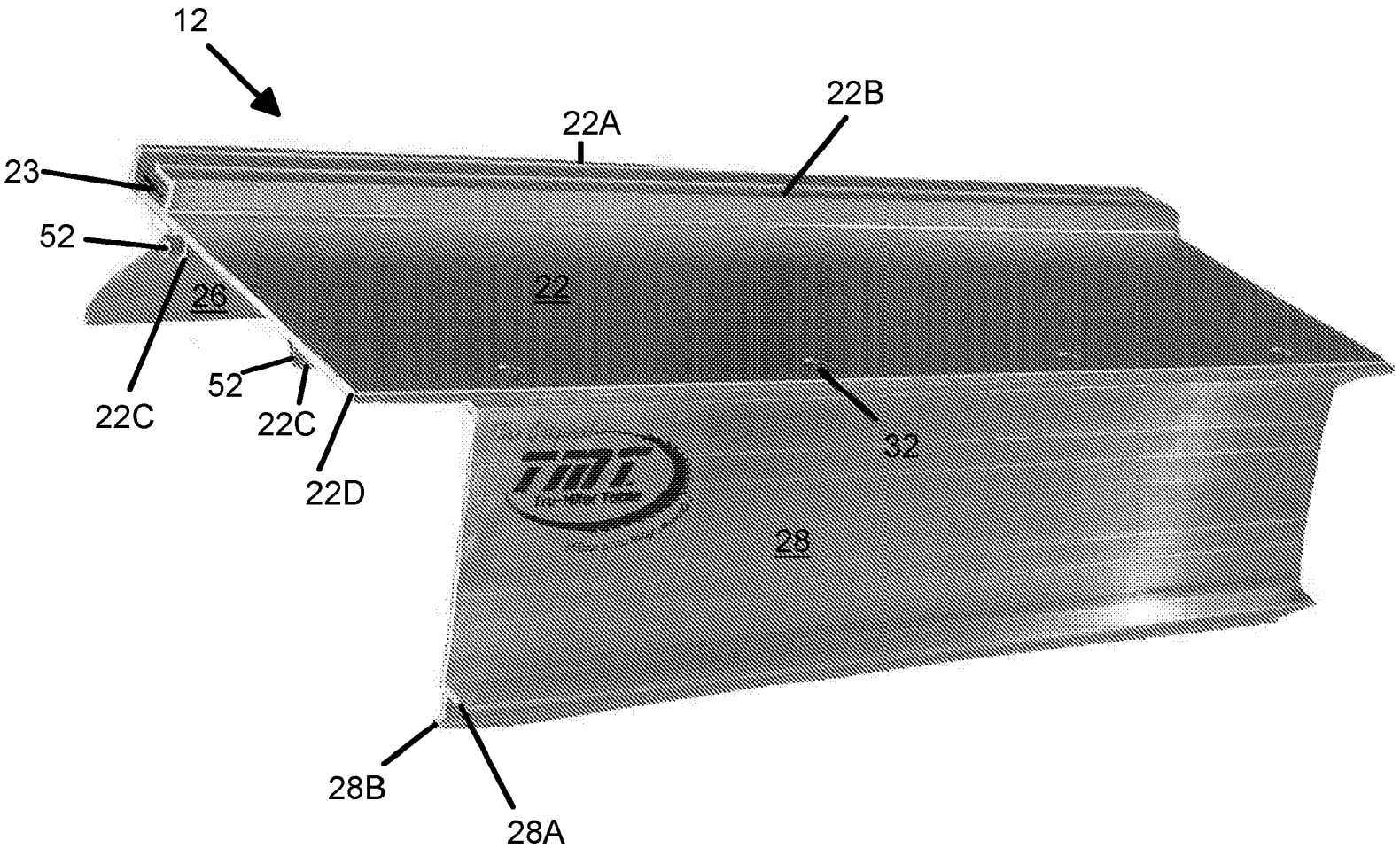
FIG. 3 depicts the structural members of the table unit.

FIG. 3 depicts the structural members of the table unit 12. The table unit 12 includes a platform 22, a rear support 26, and a forward support 28. The forward support 28 faces a worker using the portable table assembly. The platform 22 has a plurality of orifices, each orifice having a securing bolt 32 inserted through it. The plurality of orifices in the platform 22 are substantially circular. The rear support 26 and the forward support 28 have a plurality of slotted orifices through which the securing bolt 32 is inserted. The slotted orifice allows adjustment in the position of the rear support 26 and the forward support 28 to accommodate insertion into different sized ladders. The securing bolts 32 may be of a nut and bolt configuration or of a Phillips or regular screw nut and bolt configuration. The platform 22 serves to receive lumber and other construction material to which measurements and modifications are made.

Near the backward region of the platform 22, approximately where the rear support 26 would bolt to, is a first rail 22A and a second rail 22B. The first rail 22A is most rearward and the second rail 22B is more towards the internal part of the platform 22. The first rail 22A is substantially vertical and the second rail 22B is substantially "L" shaped. Between the first rail 22A and the second rail 22B is a corridor 23 through which the soft stop 40 slides along and to which it is secured against along the platform 22. Beneath the platform 22 are two half walls 22C that are substantially curved to receive and hold a dowel 52. Also beneath the platform 22 are positioning grooves 22D.

The rear support 26 has two ladder contacting flanges. A first flange 26A is substantially horizontal and a second flange 26B is substantially vertical. Similarly, the front support 26A has two contacting flanges to the ladder 14. A first contacting flange 28A and a second contacting flange 28B.

Figure 4:
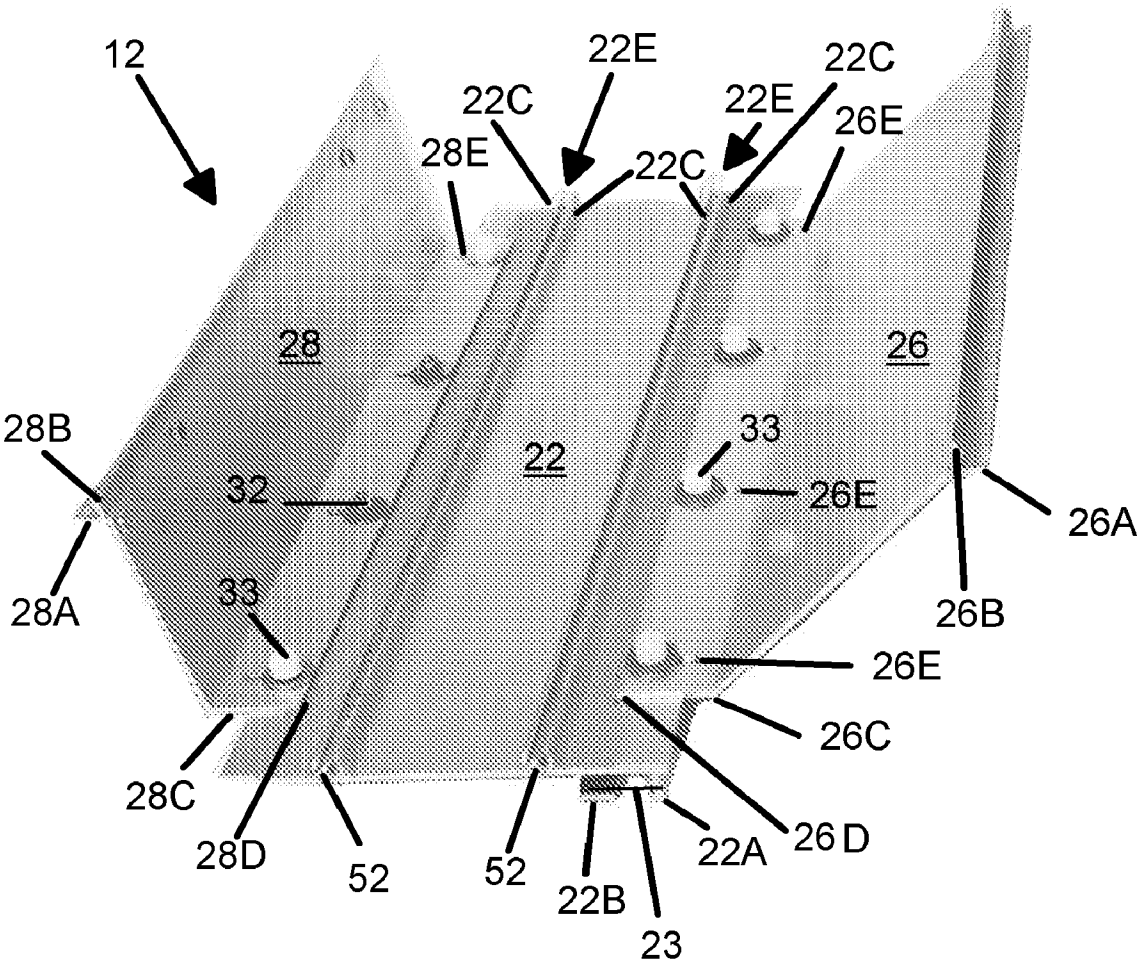
FIG. 4 depicts the table unit in an inverted configuration.

FIG. 4 depicts the table unit 12 in an upside down or inverted configuration. The bottom side of the platform 22 is seen with the first rail 22A and the second rail 22B the positioning of each defining the corridor space 23. Also, the half walls 22C are seen which form a dowel channel 22E. There are two dowel channels 22E that run substantially parallel on the bottom side of the platform 22. Each dowel channel 22E is formed by the half walls 22C, which do not completely meet. The half walls 22C are substantially curved or c-shaped. On the external side of each dowel channel 22E are the positioning grooves 22D. As shown in FIG. 4 there are approximately eight positioning grooves for each positioning groove set 22D, though the number of positioning grooves may vary. The positioning grooves serves as interlocking stops with similar configured positioning grooves located on the rear support 26 and the forward support 28.

The rear support 26 is shown with the first flange 26A, a second flange 26B, a horizontal section 26C, positioning grooves 26D extending from the horizontal section 26C, and a plurality of slotted orifices 26E. As shown in this figure four slots are visible. Similarly, the forward support 28 is shown with its first and second flanges 28A and 28B, a horizontal section 28C, positioning grooves 28D extending from the horizontal section 28C, and a plurality of slots 28C. Each slot 28C or 26C receives a securing bolt 32. Located in the forward part of FIG. 4 inside each dowel channel 22E are dowels 52.

Figure 5:
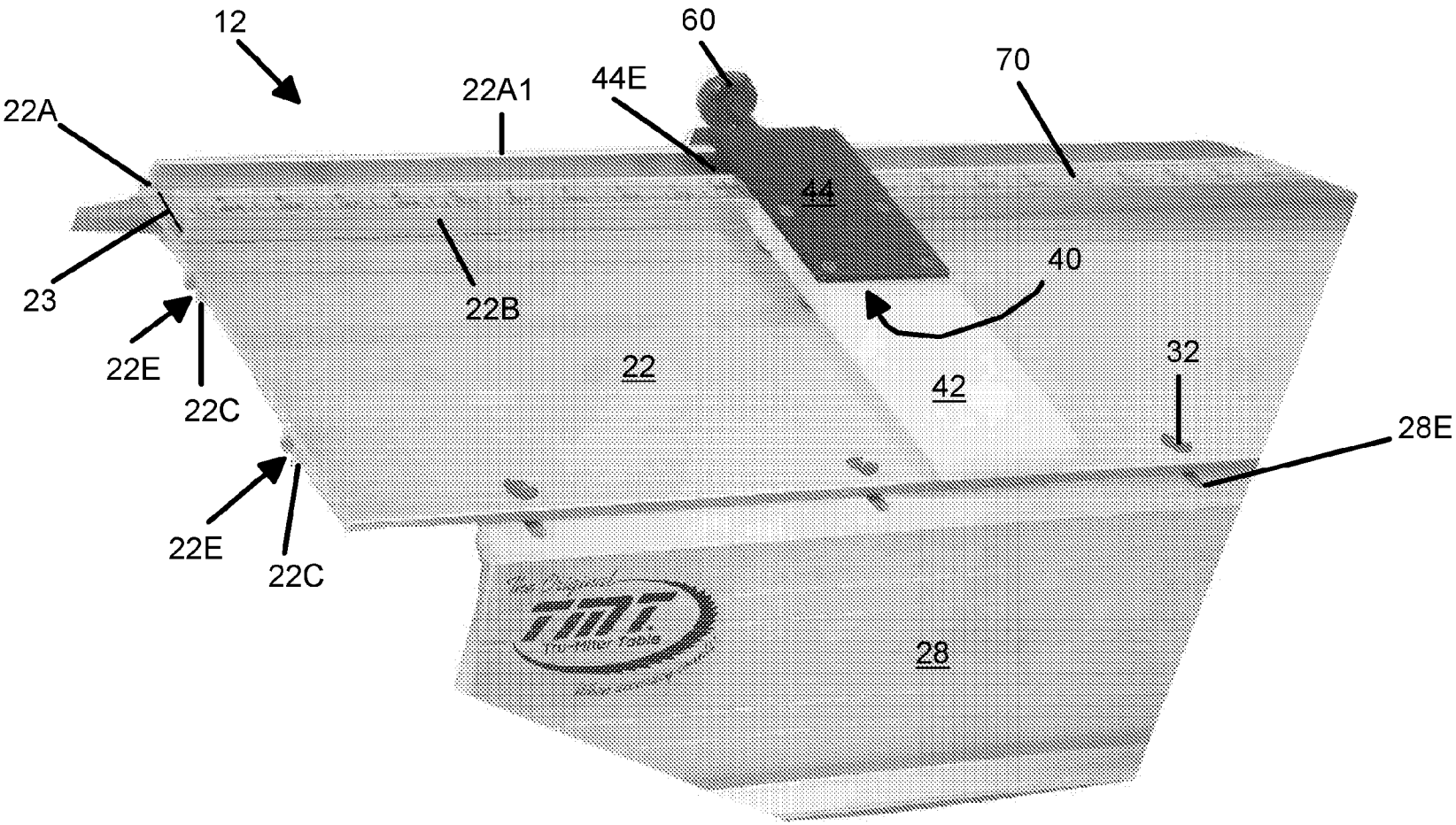
FIG. 5 is an isometric view that depicts in greater detail the components of the table unit.

FIG. 5 is an isometric view that depicts in greater detail the components of the table saw unit 12. On the platform 22 is the saw stop 40, which slides along the channel 23 and is secured at a given position by a securing knob 60. The securing knob 60 engages against the external side of the first rail 22A and via a pinching action. The saw stop 40 is comprised of three units including a block 42, a block anchor 44 and the securing knob 60. The anchor 44 has an extension 44E configured to mate with the internal wall of the first nail 22A. The pinching action caused by the rotation of the securing knob 60 engages the extension 44E against the external side of the first rail 22A and the rearward of the block 42 against the outer vertical internal wall of the second rail 22B to secure the position of the stop block 40.

Beneath the platform 22 are seen the half walls 22C which forms the dowel channels 22*e*. The forward support 28 is shown with the slots 28C through which the securing bolt 32 is inserted and secures the platform 22 against the forward support 28.

The first rail 22A has a lip overhang 22A1, which serves to assist in the engagement with the saw block 40. The L-shaped second rail 22B has a horizontal component extending from the vertical wall faces toward the internal wall of the first rail 22A. To the horizontal component is affixed a measuring scale 70. The scale 70 may be semi-permanent fixed or may be removable. The scale 70 may be continuous or segmented scale and may be graduated in either English or Metric units, or both English and metric units. The gradations of the scale 70 may vary in thickness or height between common fractional values. In one embodiment, for example, $1/16^{th}$'s of an inch will be indicated in lines that are thinner (whether or not shorter or taller) than those indicating $1/8^{th}$'s of an inch, which in turn or thinner (whether or not shorter or taller) than those indicating $1/4^{th}$'s of an inch. In this way the differentiation between units is more immediately visually apparent to the carpenter, for example, which will assist in accurate measurements and marking. In an alternate embodiment, these line thickness variations to denote unit differences can be coupled with line height differences. In an alternate embodiment, the lines denoting units can be differentiated by color. For example, $1/16^{th}$'s of an inch will be indicated in red lines, $1/8^{th}$'s of an inch, in green, and $1/4^{th}$'s of an inch in black.

The continuous scale may, for example, be continuous from 0 to 10 feet at approximately 2 feet per table unit 12 with five table units 12 continuous coupled in series. The segmented scale may be presented in two foot or 24 inch increments when five units 12 are split, for example in a 3 unit-saw-2 unit table assembly. In the 3 unit-saw-2 unit table platform assembly, approximately 6 platform feet is on one side of the saw, and two platform feet are on the other side of the saw.

Figure 6:
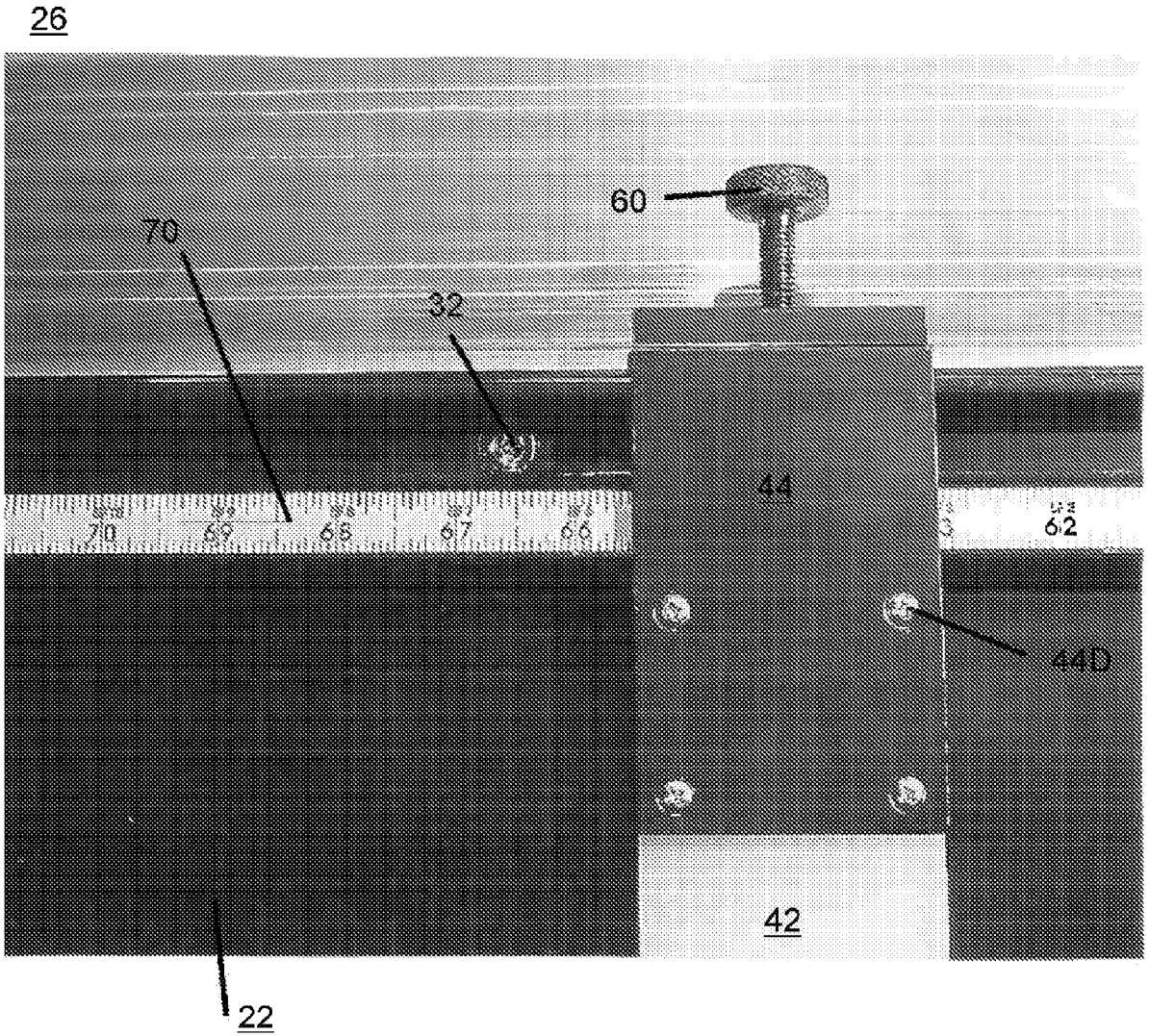
FIG. 6 is a top view of a portion of the saw stop and its engagement with the first and second rails.

FIG. 6 is a top view of a portion of the saw stop 40 and its engagement with the first and second rails 22A and 22B. The tape measure scale 70 is more clearly seen in relation to the rails 22A and 22B and the saw stop 40. The anchor plate 44 is shown with four screws 44D that penetrate through and hold the block 42. A bolt 32 is seen in the channel 23 and affixes the platform 22 to the rear support 26.

Figure 7:
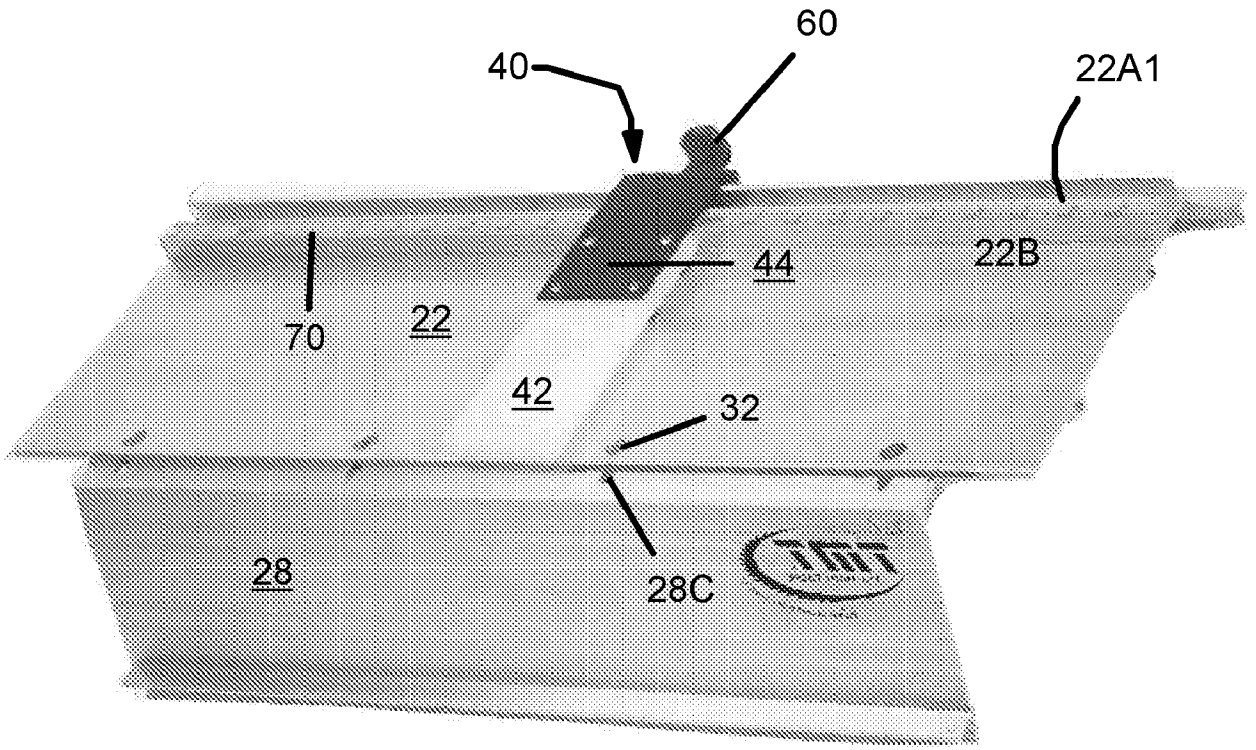
FIG. 7 is an isometric view of the chop saw and in greater detail depicts the engagement with the first and second rails.

FIG. 7 is an isometric view of the chop saw 40 and in greater detail depicts the engagement with the first and second rails 22A and 22B. Here, the block 42 is shown in a substantially rectangular configuration where the edges that engage with the surface of the working platform 22 are beveled to assist in the sliding of the chop saw 40. Also depicted in FIG. 7 in greater detail is the lip overhang 22A1. A bolt 32 is shown engaging the slot 28E through which the platform 22 is secured to the front support 28.

Figure 8:
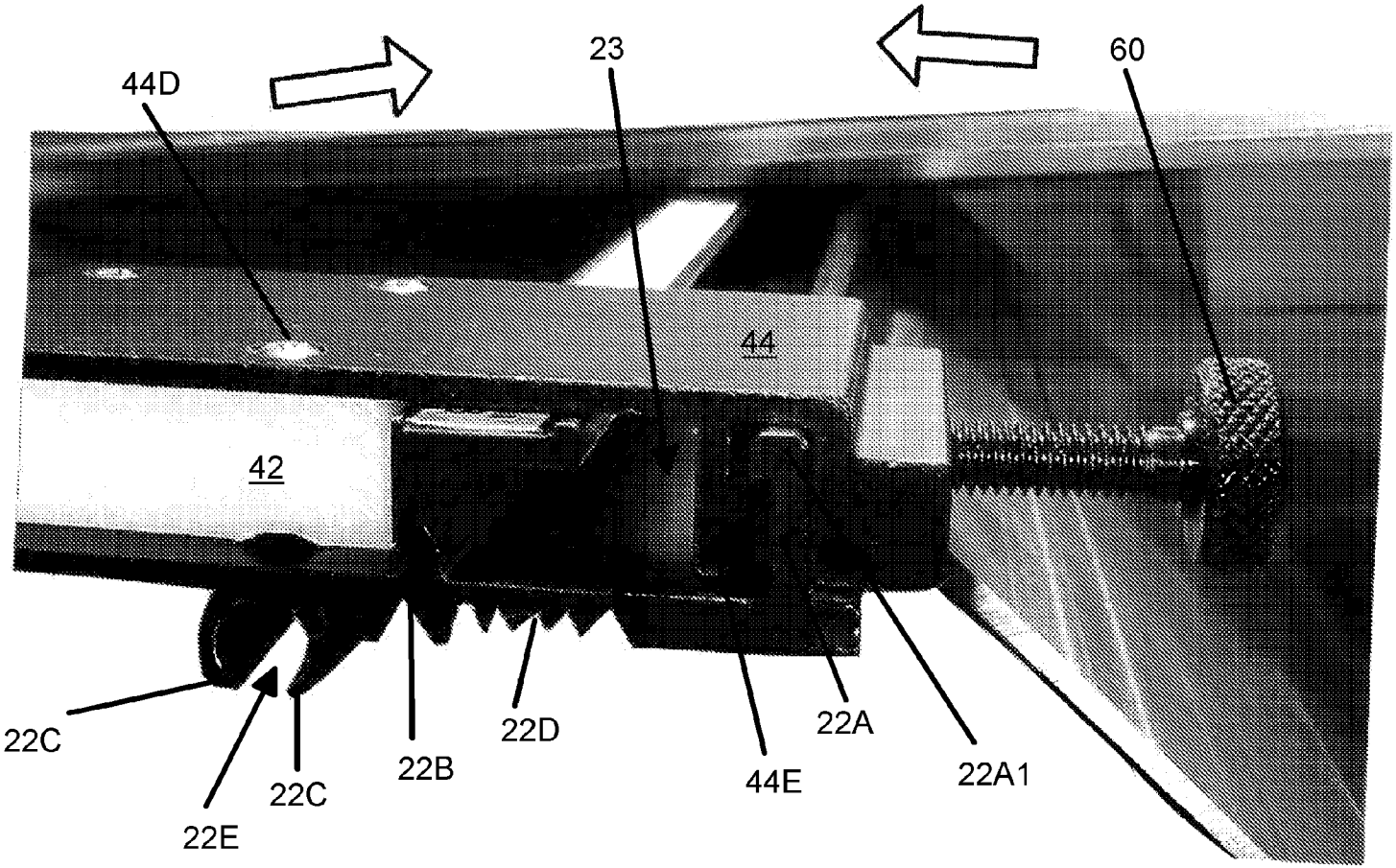
FIG. 8 is a side view of a portion of the top saw and its relative configuration with the channel defined by the first rail and the second rail.

FIG. 8 is a side view of a portion of the saw stop 40 and its relative configuration with the channel 23 defined by the first rail 22A and the second rail 22B. Also depicted in greater detail is the dowel channel 22E defined by the two curved half walls 22C. Adjacent to the external half wall 22C are the positioning grooves 22D. The engagement of the saw stop 40 and securing process is represented by the arrows in FIG. 8. The anchor plate 44 has the extension 44E, which upon the inward rotation of the securing knob 60 braces against the internal wall of the first rail 22A. The extension 44E is complementarily configured to engage in a "tongue and groove" fashion the lip overhang 22A1 and the internal wall of the first rail 22A. Near the same time, the edge of the block 42 engages against the vertical member of the second rail 22B. Thus, both rails 22A and 22B are engaged with two members of the saw stop 40 specifically, extension 44E of the anchor plate 44, and the edge of the block 42 against the second rail 22B.

Figure 9:
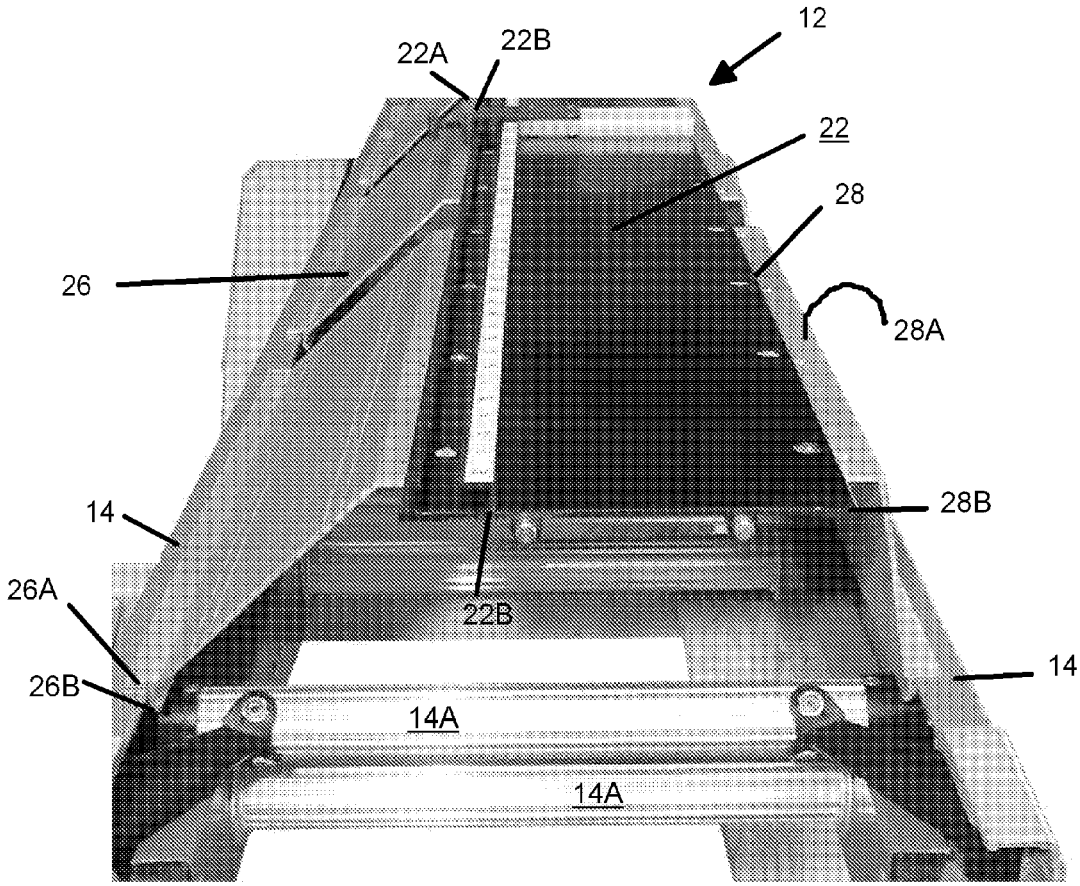
FIG. 9 shows the engagement of the respective first and second flanges and the rear support and the first and second flanges of the forward support with the ladder rails.

FIG. 9 shows the engagement of the respective first and second flanges 26A and 26B of the rear support 26 and the first and second flanges 28A and 28B of the forward support 28, with the ladder rails 14. Also depicted in FIG. 9 are ladder steps 14A spanning between the ladder rails 14 and the platform 22 connects to the rear and forward supports 26 and 28. Also shown are the half walls 22C and the first and second rails 22A and 22B. Depending on the adjustments of positioning grooves 26D and 28D with positioning grooves 22D, the flanges 26A and B snap engage with a spring-like compression and friction with the ladder rails 14 thereby eliminating the need for any further connecting hardware to hold the table assembly firmly in place on the ladder rails.

Figure 10:
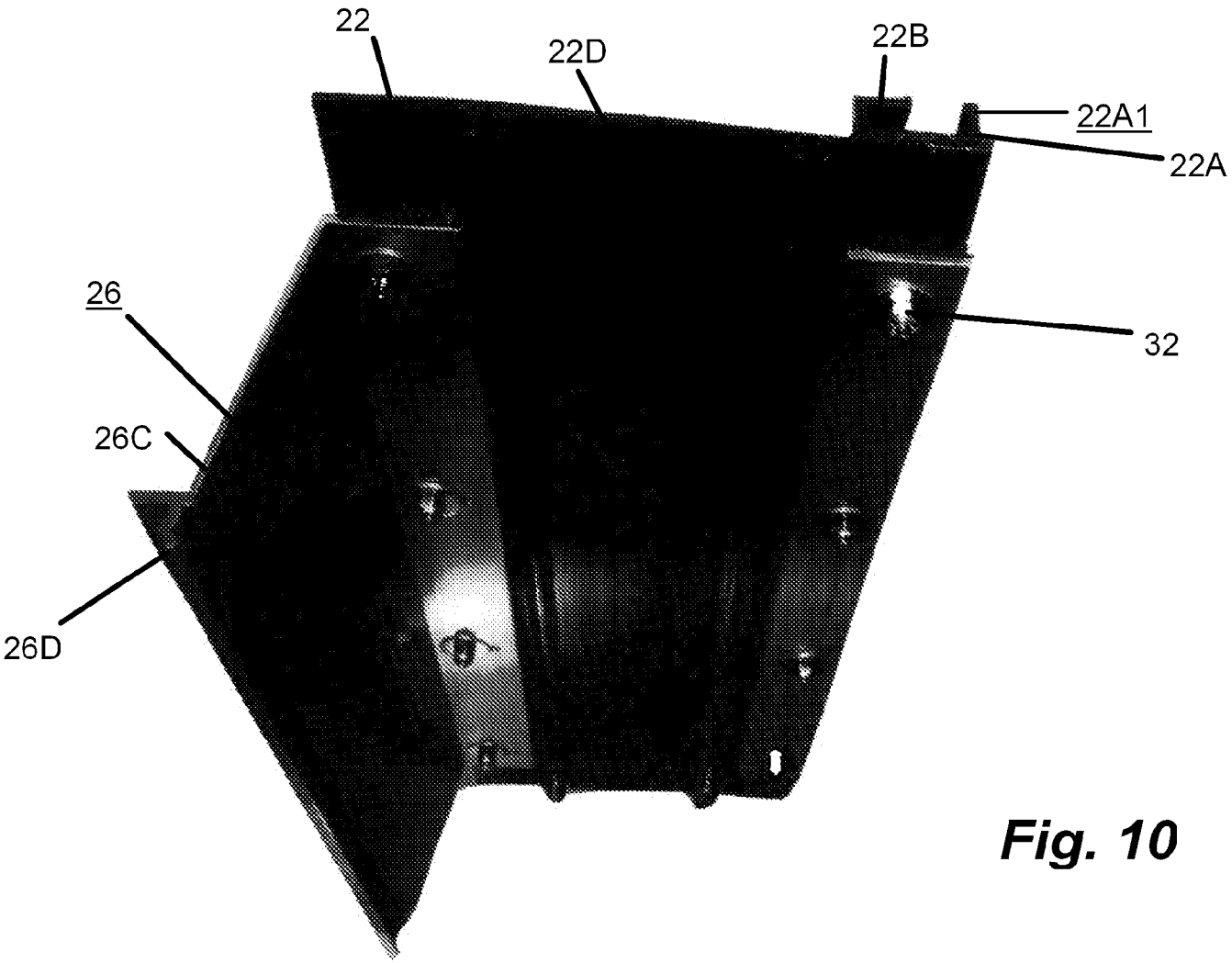
FIG. 10 depicts the engagement of the rear support with the positioning grooves of the platform.

FIG. 10 depicts the engagement of the rear support 26 with the positioning grooves 22D of the platform 22. The rear support 26 has two positioning grooves 26D extending from the horizontal section 26C. Depending upon the sliding clearances available in the slots 26E, the positioning grooves 26D engage with the positioning grooves 26D. Thereafter the securing bolt 32 is secured and further lateral sliding of the platform 22 is prevented by the respective interlocking engagement of the positioning grooves 26D with the positioning grooves 22D. Bolt 32 can be covered with cap 33. Also shown in FIG. 6 are the first and second rails 22A and 22B along with lip overhang 22A1 and the first and second components of the second rail 22B. These mechanisms enable the system to be adaptable to ladders of differing widths. However, the system can also be set for one size an extruded from a single piece instead of assembled from separate pieces. Ordinarily however, adjustability will be preferred.

Figure 11:
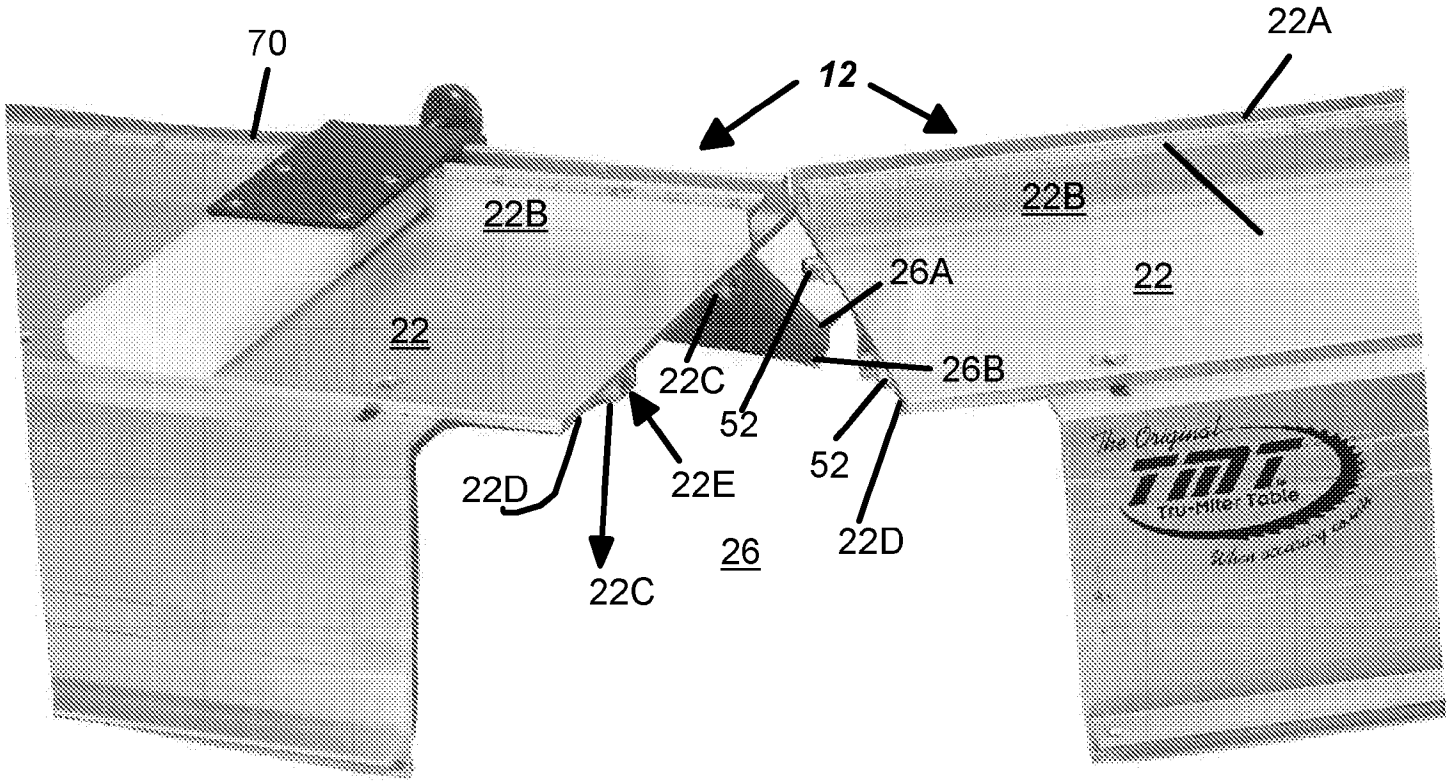
FIG. 11 is an isometric view of the positioning of two table units for engagement and inter-locking via the dowels into the dowel aperture.

FIG. 11 is an isometric view of the positioning of two table units 12 for engagement and inter-locking via the dowels 52 into the dowel aperture 22E. On the left side of FIG. 1 is a table unit 12 which shows the underside of the platform 22 and its respective half walls 22C defining the dowel space 22E. Similarly, on the right side of the figure is the dowel 52 positioned in the right table unit 12 for eventual engagement into the left table unit 12 via dowel 52 insertion.

Figure 12A:
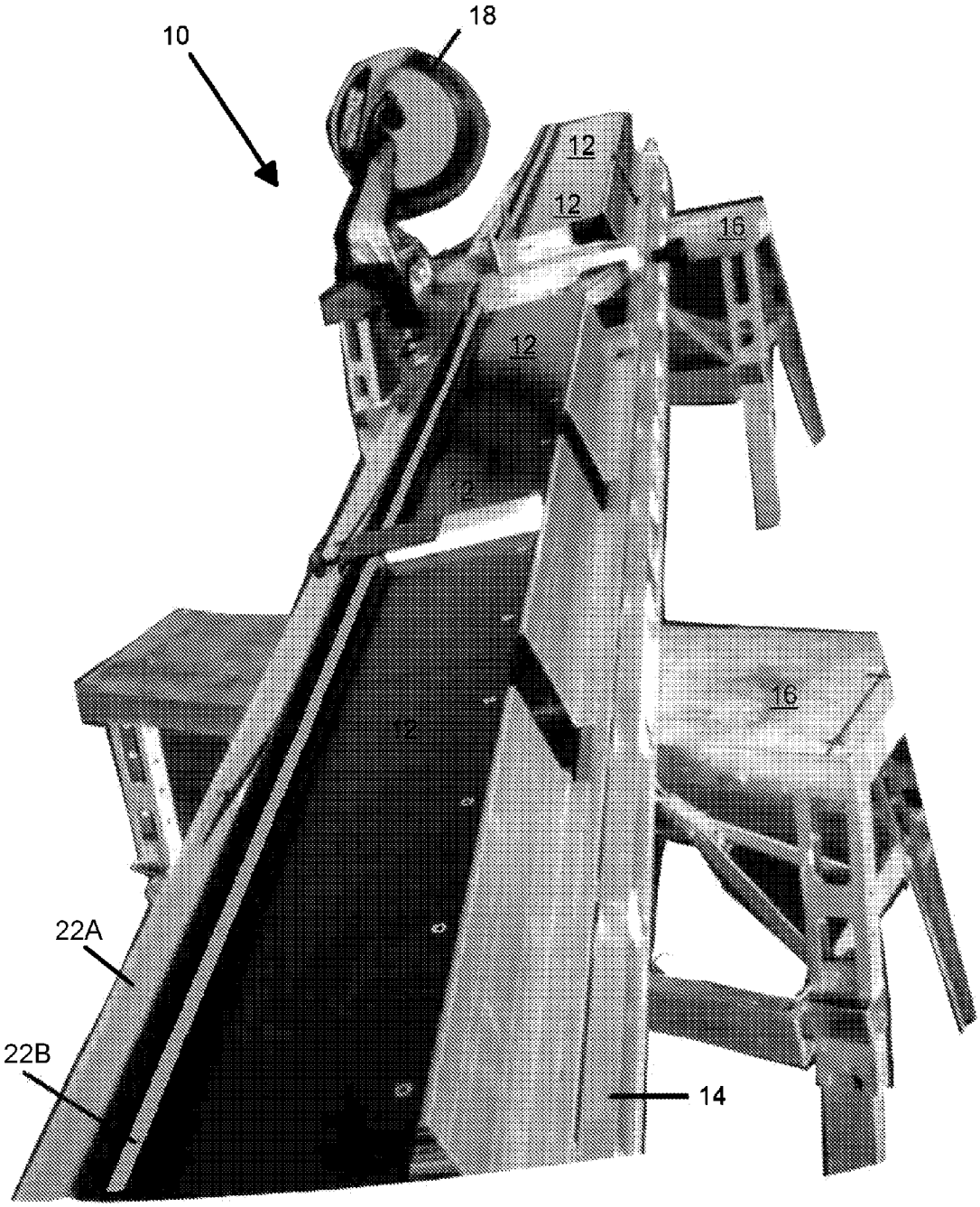
FIGS. 12A, 12B and 12C depict alternative arrangements of the assembled portable table.
Figure 12B:
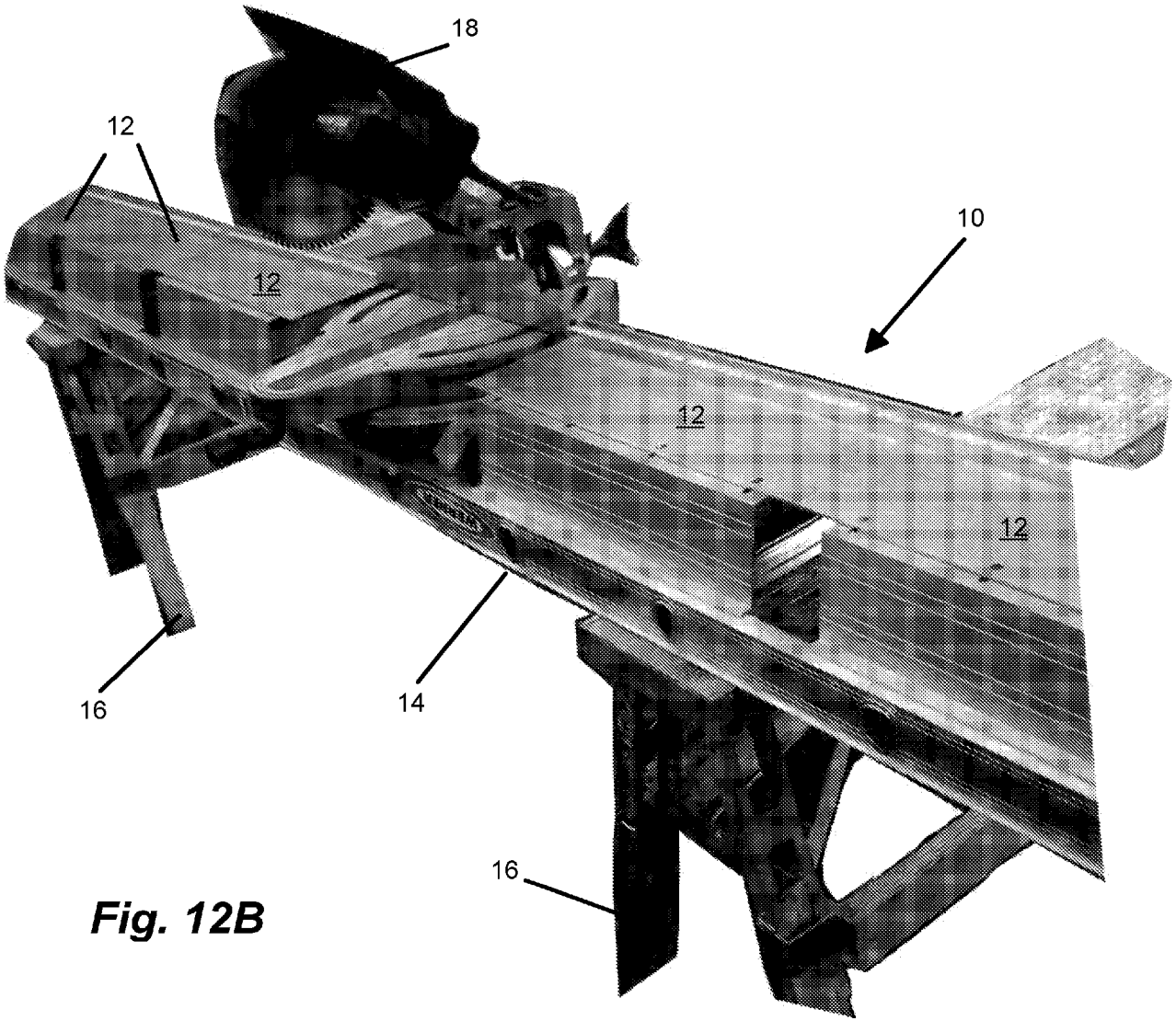
Figure 12C:
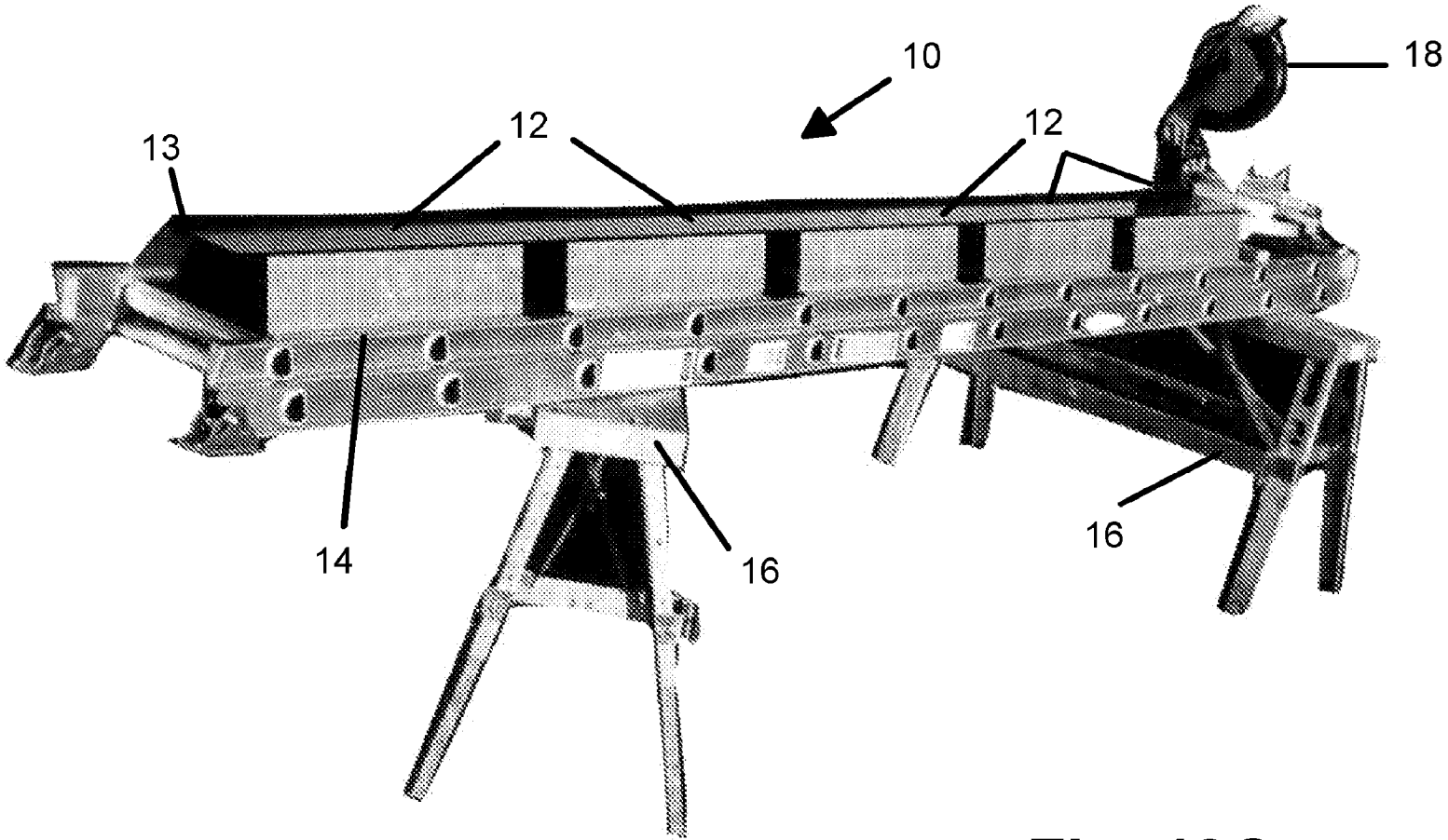

FIGS. 12A, 12B and 12C depict alternative arrangements of the assembled portable table. FIG. 12A depicts a six table unit 12 assembly where the saw 18 is between a four unit 12 section and a second unit 12 section. Also shown on FIG. 12A is rail 22A which, besides structural support, provides a backstop where the workpiece (e.g. a board) can be pushed against to ensure that the cut is at the desired angle as measured by the saw (e.g. perpendicular or 90 degrees). All are assembled on a ladder 14 spanning across two workhorses 16. FIG. 12B is similar to FIG. 12A in that a three and two unit 12 assembly is shown where the table saw 18 is between three unit 12's and two unit 12's section. In FIG. 12C is shown the saw 18 at the end of a five unit 12 assembly.

Figure 13:
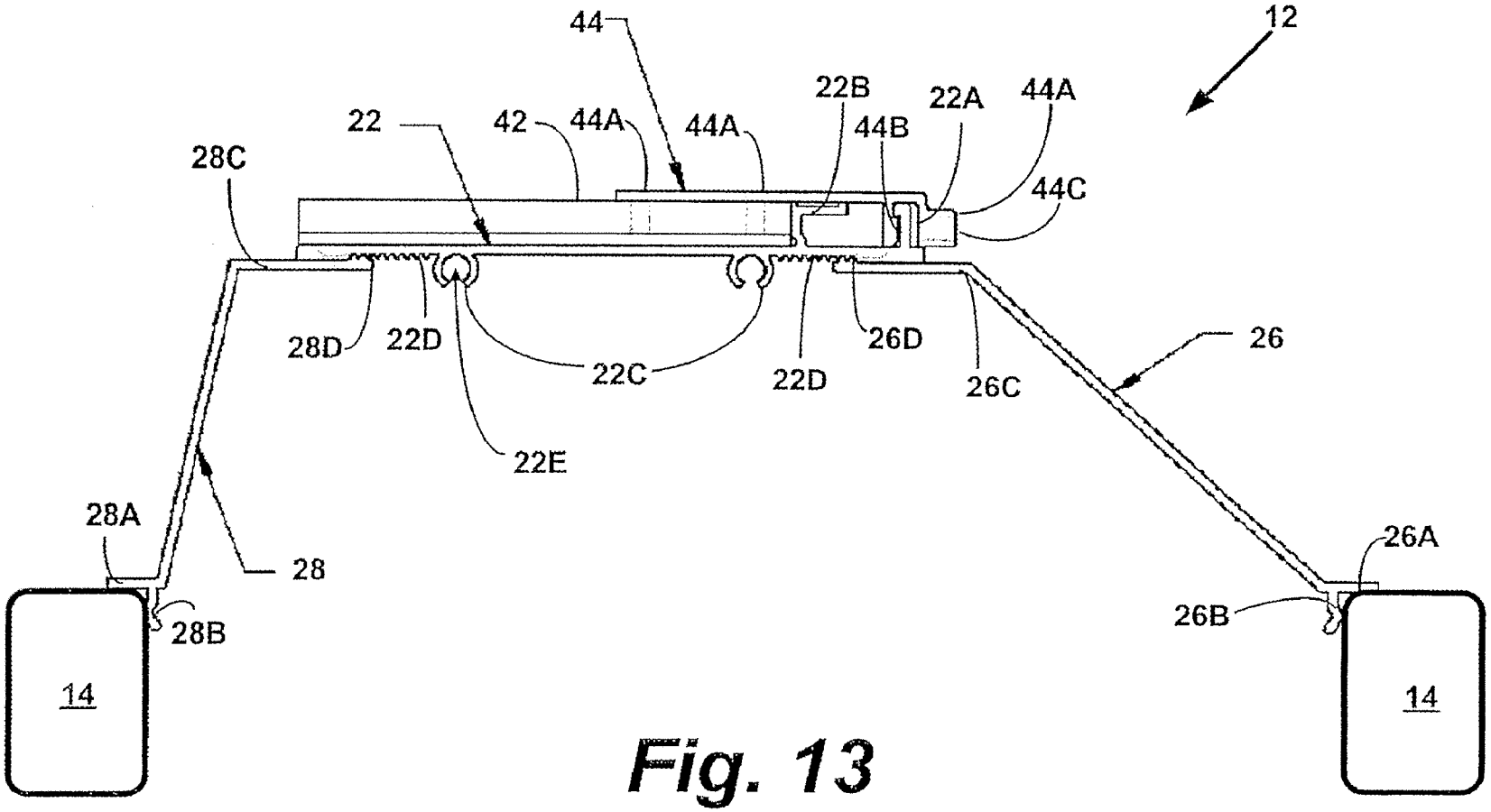
FIG. 13 is a side cross-sectional view of the table unit.

FIG. 13 is a side cross-sectional view of the table unit 12. Here the relative geometrical arrangements of the platform 22C, the rear support 26 and the forward support 28. The respective first and second flanges 26A and 26B and 28A and 28B are shown engaged with the ladder rails 14. Also shown are the half walls 22C forming the dowel channels 22E. Adjacent to the dowel channels 22E are the positioning grooves 22D. The positioning grooves 26D of the rear support 26 engaged with grooves 22D of the platform 22C. Similarly, one can see the positioning grooves 28*d* engaged against the positioning grooves 22D. Spanning across the working platform 22 is also seen in cross-section the block 42, anchor 44 engaged against the first and second rails 22A and 22*b*. The outwardly bend projection of second flanges 26B and 28B respectively assist in the grabbing-like engagement with the latter rails 14.

Figure 14:
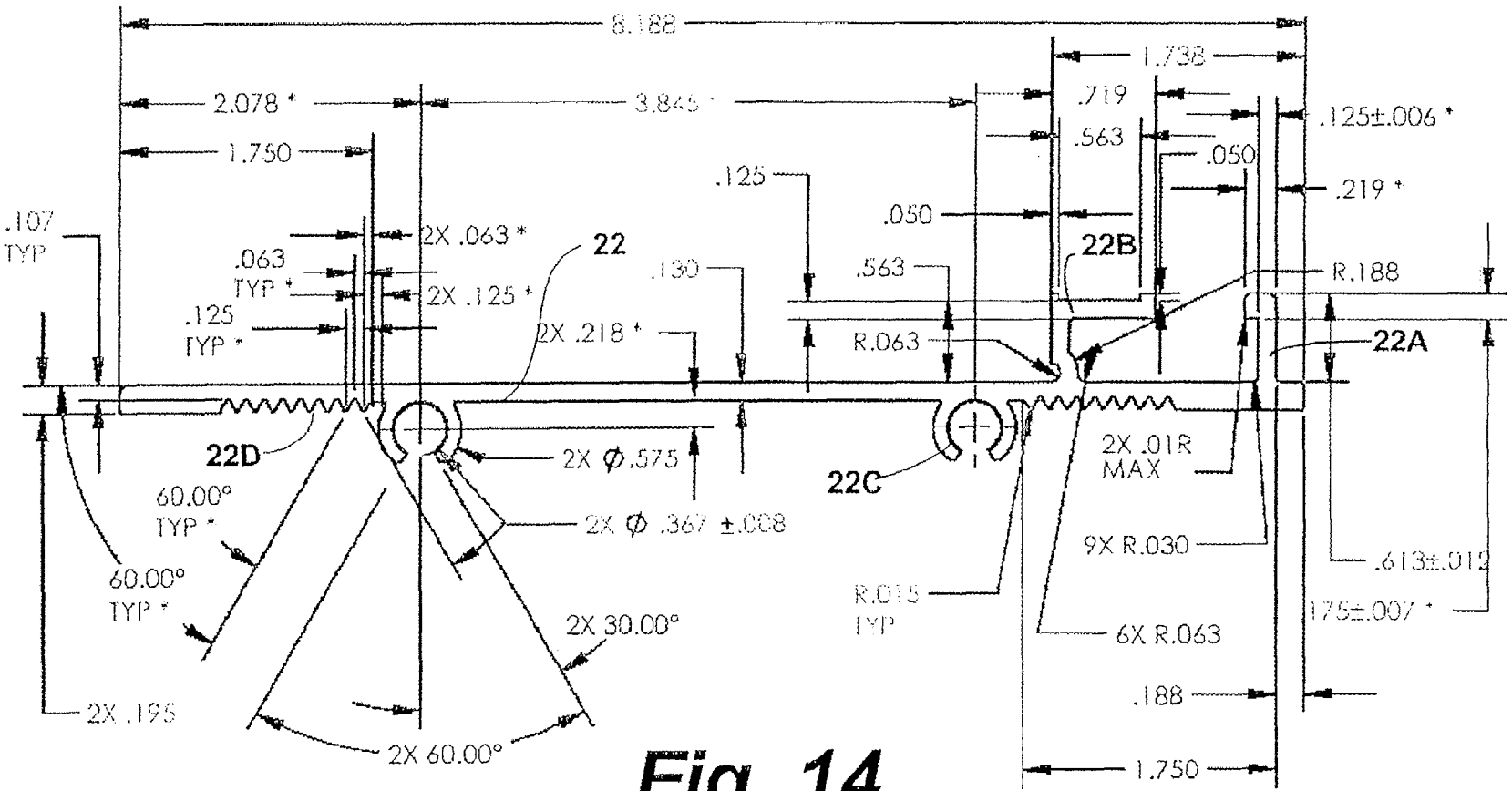
FIG. 14 shows in cross section the working platform and depicts the angular and dimensional specifications of the preferred embodiment.

FIG. 14 shows in cross section the working platform 22 and depicts the angular and dimensional specifications of the preferred embodiment. The half walls 22C are separated by a 60-degree angle and the stock material is of aluminum in the preferred embodiment. Other materials may be used, for example, plastics. The first and second rails 22A and 22B are approximately 0.125 inches thick and the walls forming positioning grooves 22D are approximately 60 degrees spaced between each other. In this preferred embodiment, the width of the working platform is approximately 8.2 inches wide and the rails are approximately 0.61 inches tall. The length of the working platform 22 is approximately 24 inches long where the rear support 26 and forward support 28 are off-set from each end by approximately 2 inches from the dowel channel edges of the platform 22.

Figure 15:
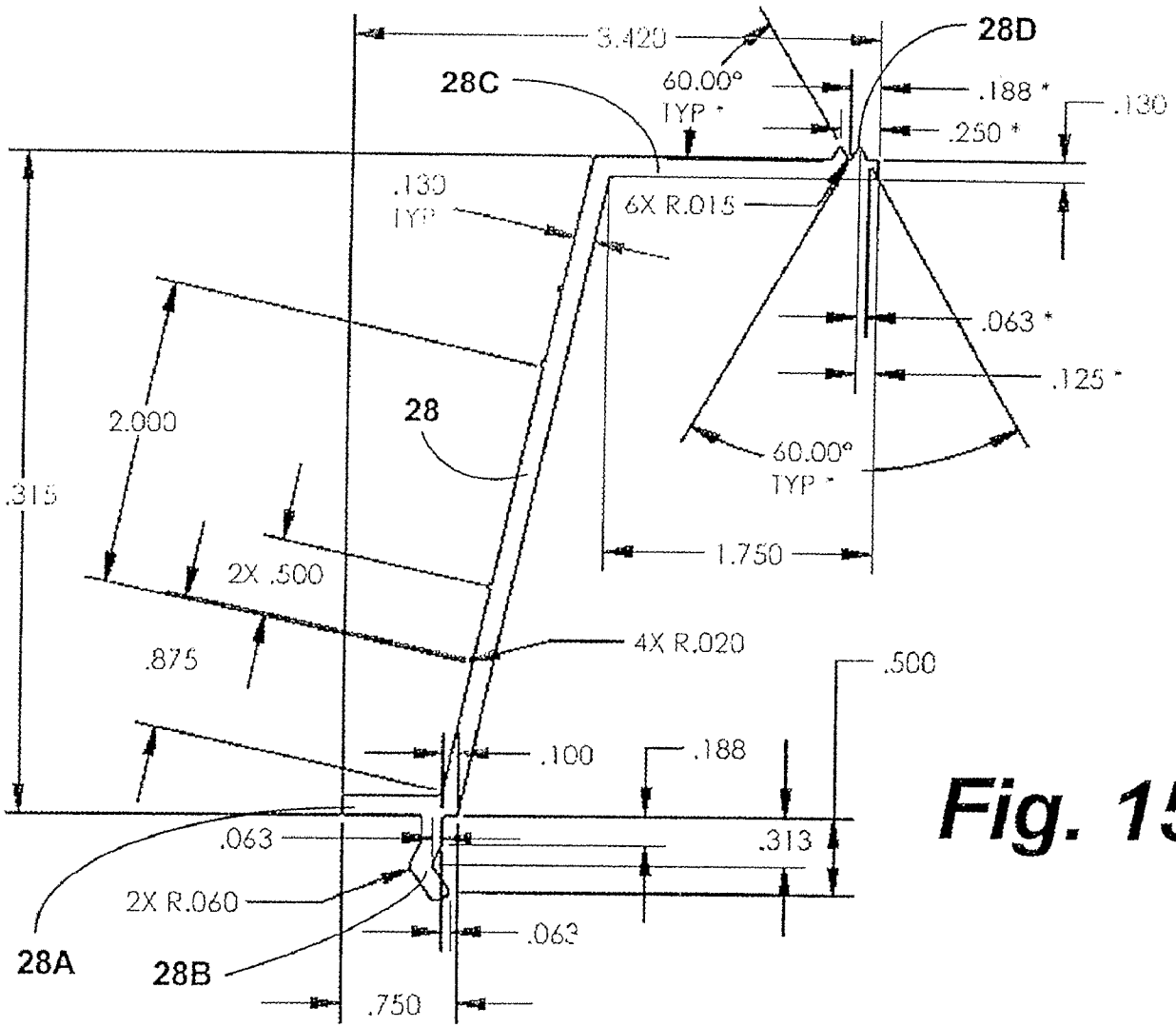
FIG. 15 depicts in side cross-sectional view the front support.

FIG. 15 depicts in side cross-sectional view the front support 28. The front support 28 shows the ladder rail engagement flanges 28A and 28B, the substantially vertical component 28 which then has a horizontal component 28C near the end of which are two positioning grooves 28D. The thickness of the forward support 28 is approximately 0.13 inches and the grooves are angled by approximately 60 degrees. The second flange 28B has an apex to engage against the ladder rail 14. The apex is a pointed-like protrusion so that firm engagement with the ladder rails 14 is accomplished. The front support 28 is approximately 4.3 inches in vertical height and approximately 3.4 inches wide from outermost edge of the first flange 28 and the end of the horizontal section 28C. The forward support 28 is approximately 20 inches long.

Figure 16:
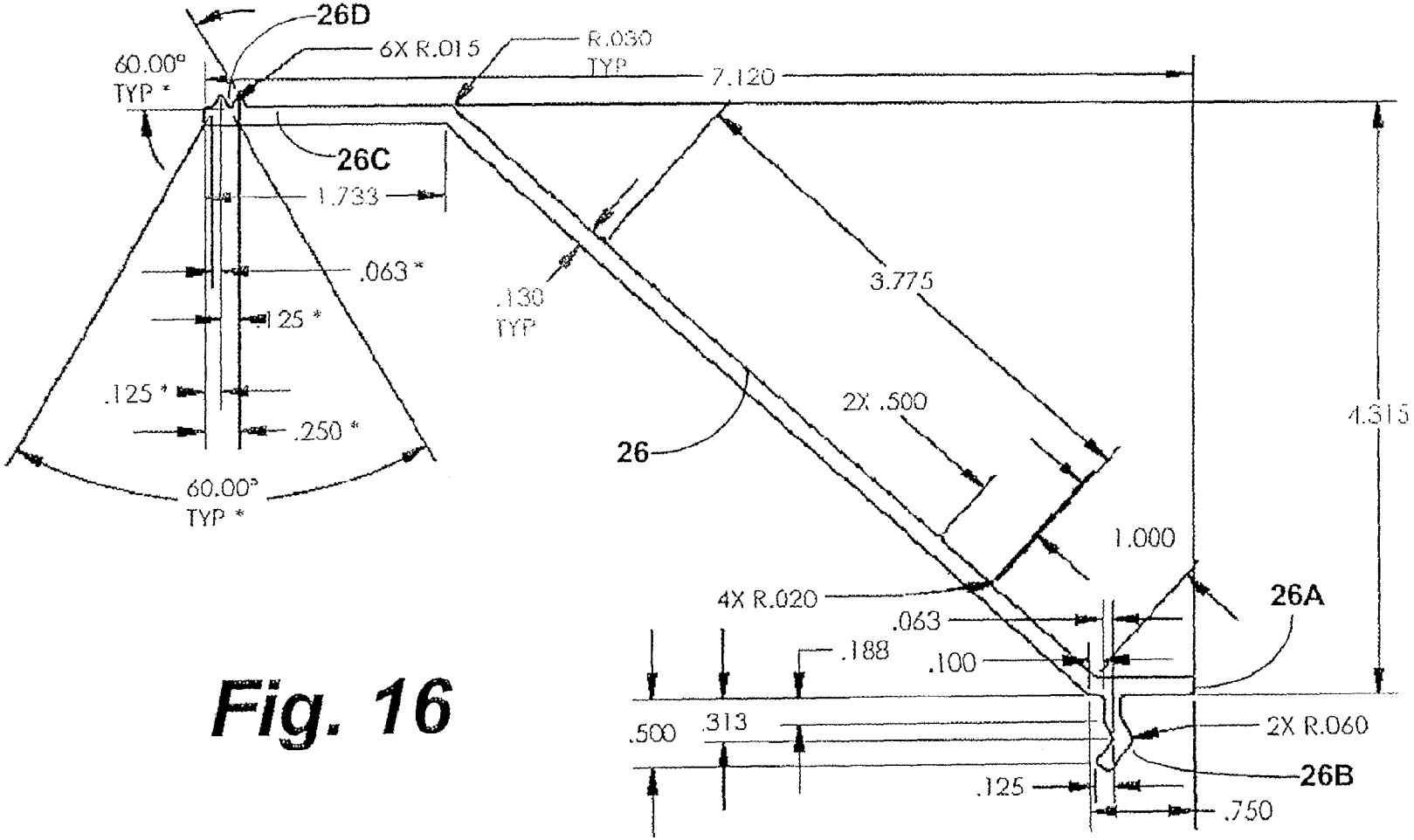
FIG. 16 depicts in cross-sectional view the rear support.

FIG. 16 depicts in cross-sectional view the rear support 26 and is similarly composed of comparable dimensions to the front support. The differences are that though the height is the same approximately 7.12 inches span from the end of the first flange 26A to the end of the horizontal unit 26C. The rear support 26 is approximately 20 inches long. Near the end of the horizontal section 26C are two positioning grooves 26D with 60 degrees spacing between. The second flange 26B has an apex point configured to engage against the ladder rail 14.

Figure 17B:
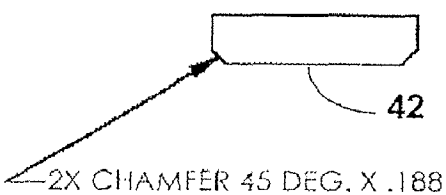
FIG. 17B shows a cross-sectional view of the block.
Figure 17A:
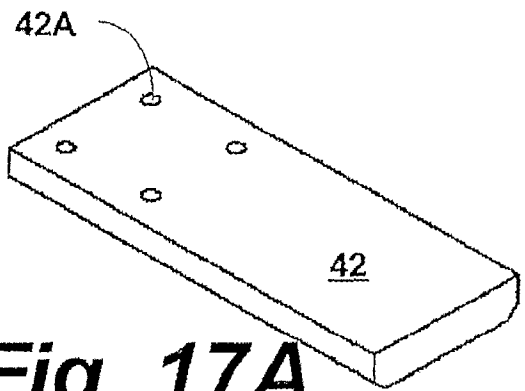
FIG. 17A is an isometric view of the block.
Figure 17C:
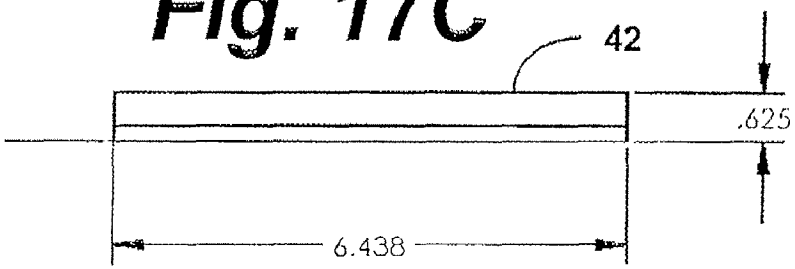
FIG. 17C shows another cross-sectional view of the block.
Figure 17D:
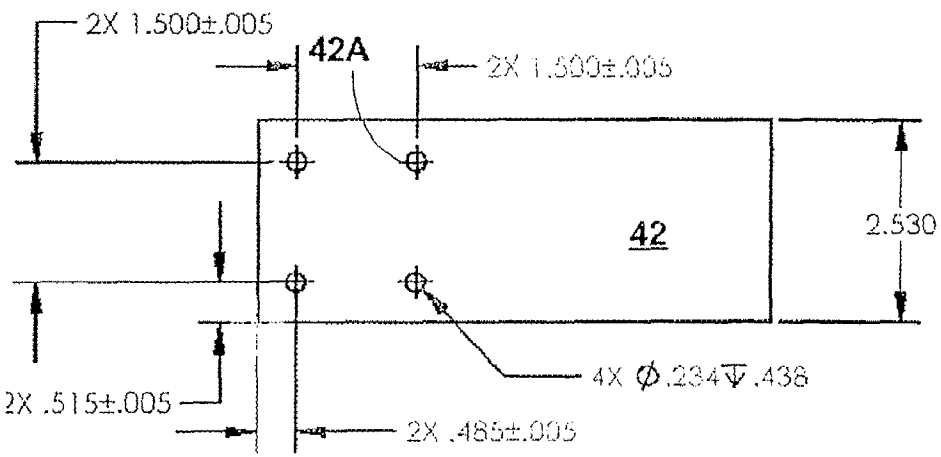
FIG. 17D is a top view of the block and shows the relative spacing of the apertures.

FIG. 17A is an isometric view of the block 42. The block 42 has two beveled edges to assist in sliding along the platform 22 and has four apertures 42A to receive securing screws. FIG. 17B shows the front edge in cross-section of the block 42 in which the bevels show a 45-degree chamfer. FIG. 17C shows in cross-section the length of the block 42, which is approximately 6.4 inches and is approximately 0.625 inches thick. FIG. 17D is a top view of the block 42 and shows the relative spacing of the apertures 42A. The apertures 42A are approximately 1.5 inches apart center-to-center and offset from the edges of the block 42 by approximately 0.52 inches.

Figure 18A:
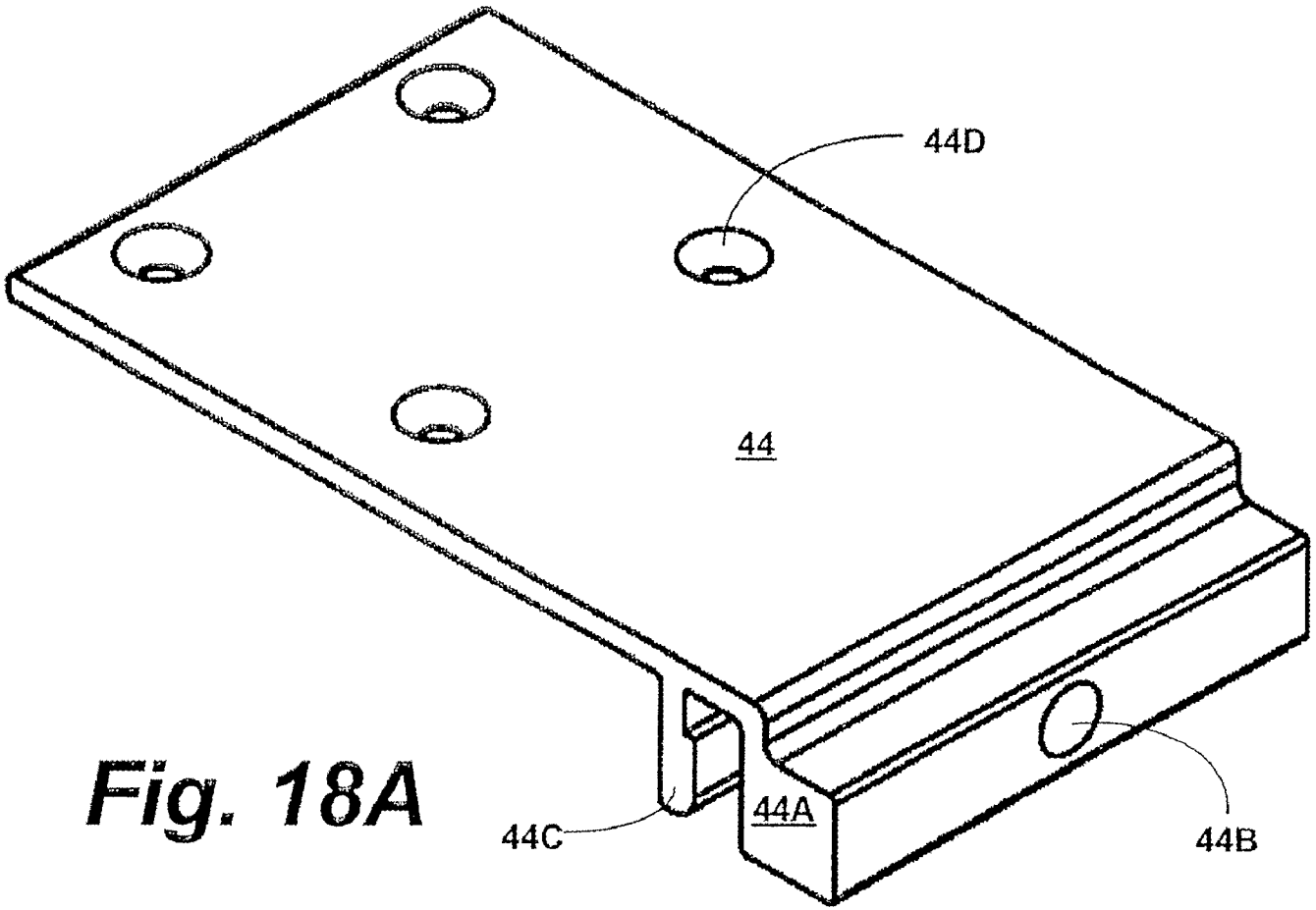
FIG. 18A is an isometric view of the anchor plate and adjacent structures.
Figures 18B, 18C, 18D:
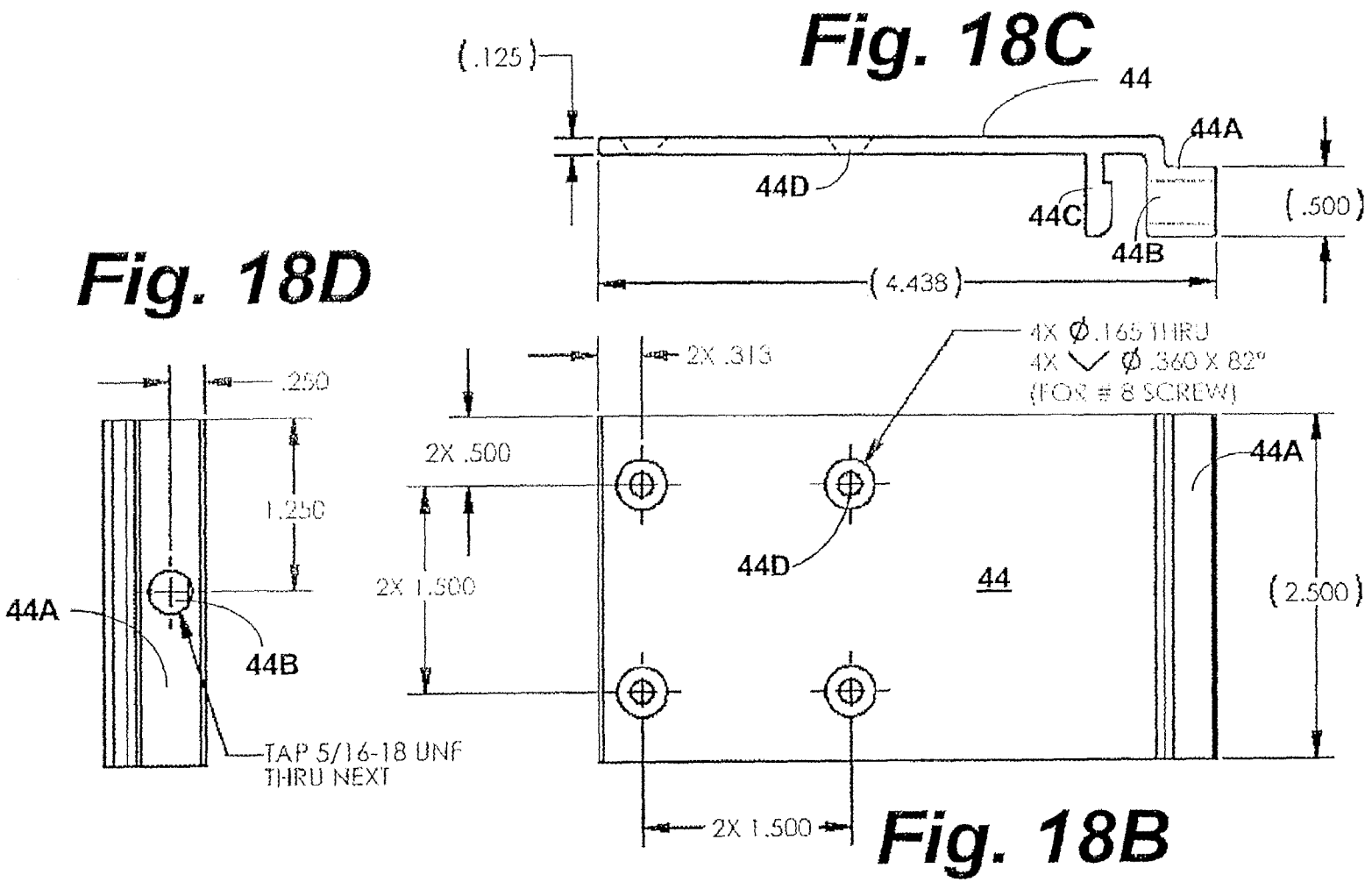
FIG. 18B is a top view showing the relative dimensions of the anchor plate.
FIG. 18C shows in cross section the anchor plate with the geometrical specifications.
FIG. 18D shows a side view of the anchor plate where the knob aperture is located.
Figure 18E:
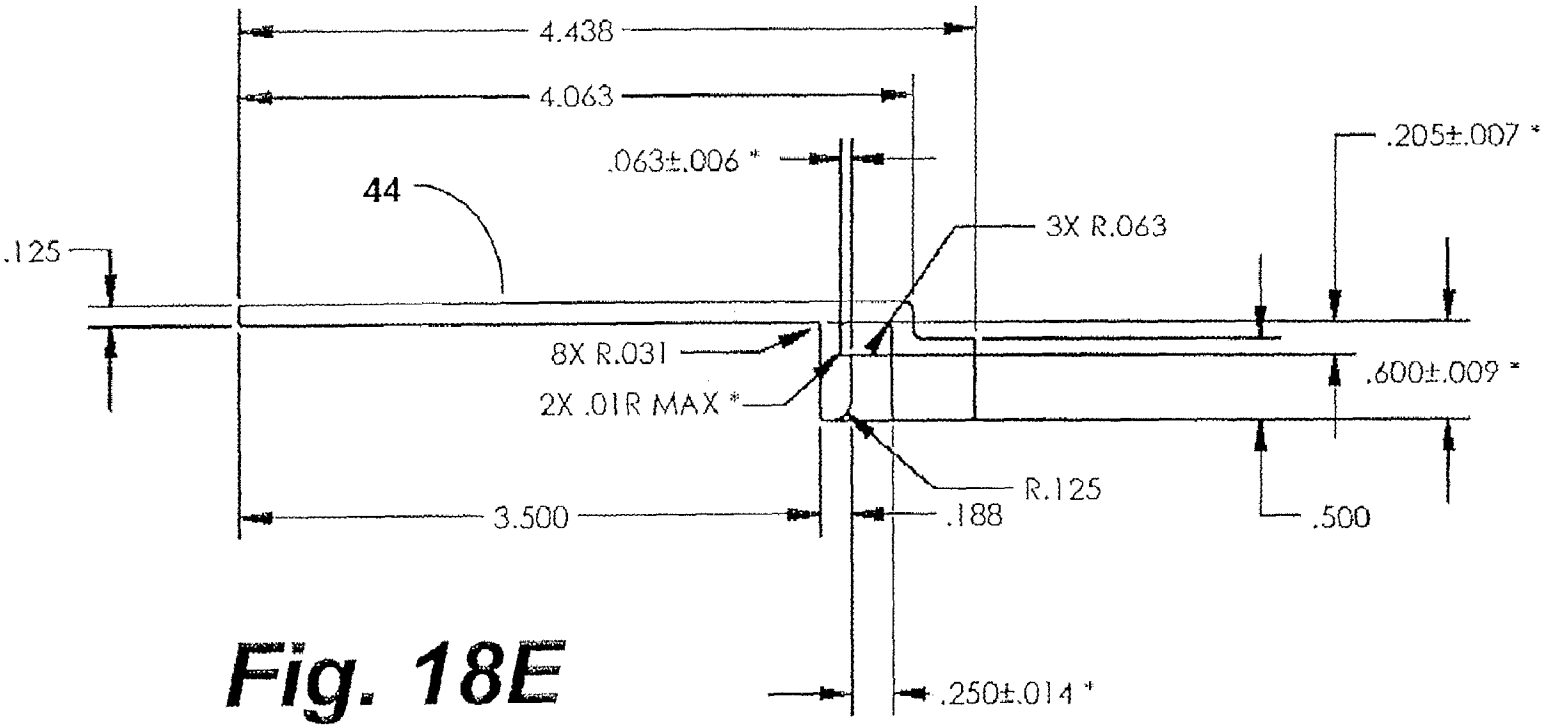
FIG. 18E is another cross-sectional site view with geometrical specifications.

FIG. 18A is an isometric view of the anchor plate 44 showing a first flange 44A, an aperture 44B, which receives the securing knob 60, a second flange 44C and four apertures 44D to receive securing screws. The aperture 44B is threaded to engage with the helical grooves of the shaft attached to the knob 60. FIG. 18B is a top view showing the relative dimensions of the anchor plate 44. The anchor plate 44D apertures are approximately 1.5 inches apart center-to-center and offset from the edges of the anchor plate by approximately ½ inch for two of the internal apertures 44D and approximately 0.313 inches from the internal edge of the anchor plate. FIG. 18C shows in cross section the anchor plate 44 where the geometrical specifications are noted. The anchor plate is approximately 0.125 inches thick. The securing hole aperture 44B is shown in FIG. 18D and is tapped at 5⁄16ths of an inch and is approximately 1.25 inches from the edge of the anchor plate 44. FIG. 18E is another cross-sectional site view of the anchor plate 44 and provides additional specifications of the preferred embodiment.

Figures 19A, 19B:
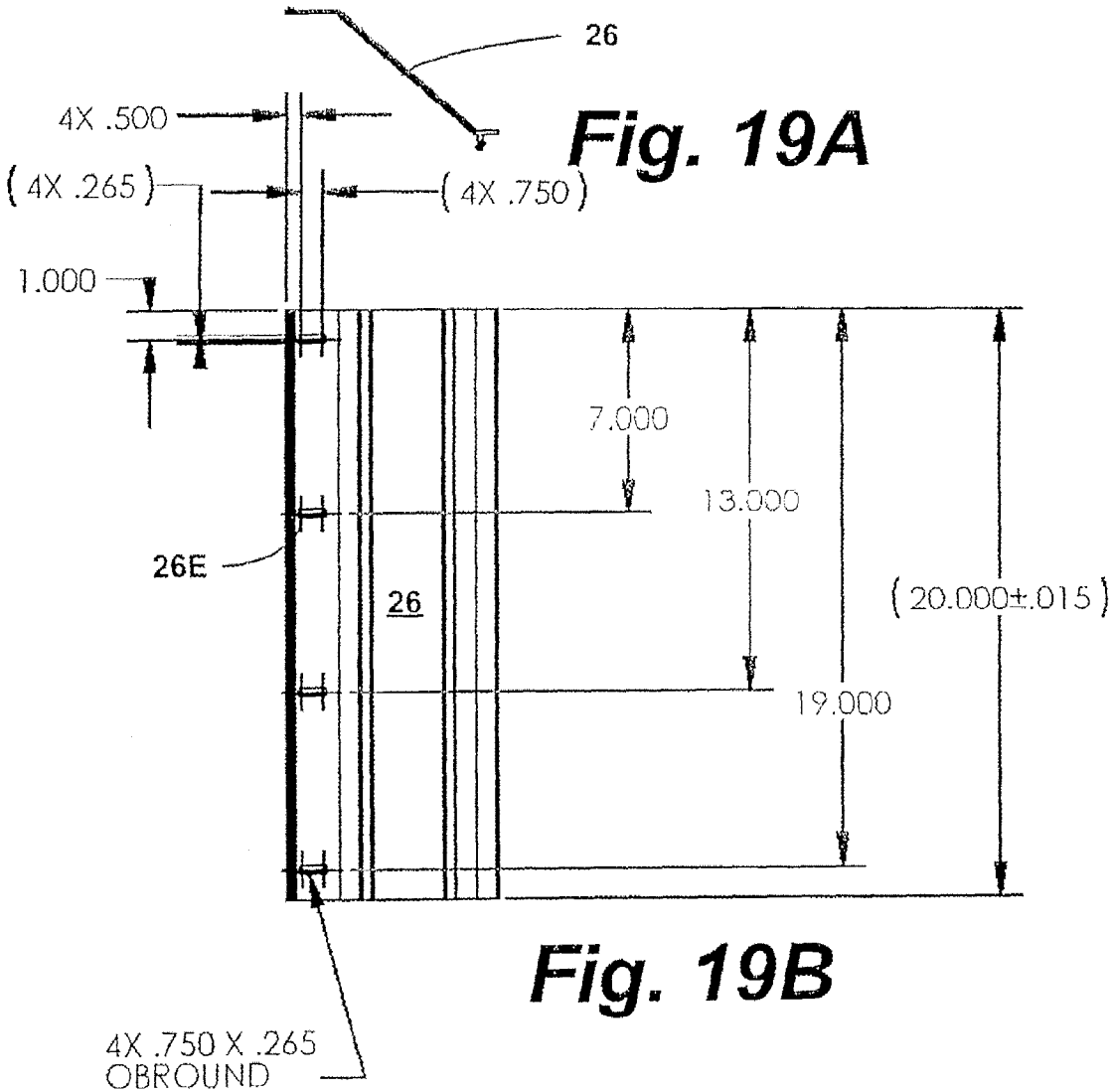
FIG. 19A is a cross-sectional view of the rear support.
FIG. 19B is a top view of the rear support and shows the relative geometry of the slotted orifices.

FIG. 19A is a cross-sectional view of the rear support 26. FIG. 19B is a top view of the rear support 26 and shows the relative geometry of the slotted orifices 26E. The slotted orifices 26E are approximately 0.265 inches in width and 0.75 inches in length. The slots are off-set from the edges of rear support 26 by approximately 1 inch center-to-edge and are separated from each other by approximately 6 inches, center-to-center.

Figures 20A, 20B:
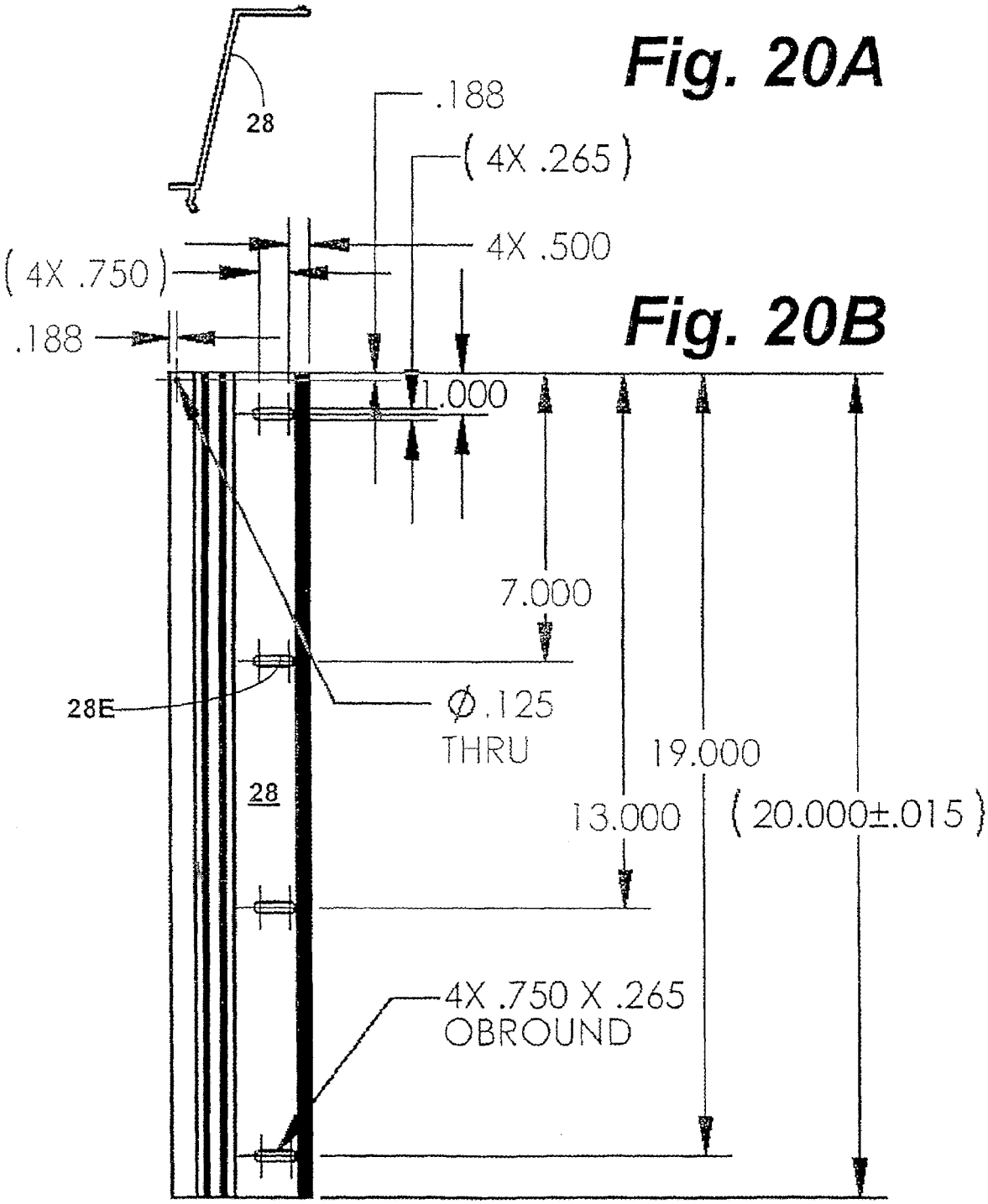
FIG. 20A is a side cross-sectional view of the front support.
FIG. 20B is a top view of the front support and shows the relative position of the slotted orifices.

FIG. 20A is a side cross-sectional view of the front support 28. FIG. 20B is a top view of the front support 28 and shows the relative position of the slotted orifices 28E. The slotted orifices 28E are approximately 0.265 inches wide and 0.75 inches long and are separated from each other by approximately 6 inches. The edge slots are off-set from the edge of the front support 26 by approximately 1 inch.

While the preferred embodiment of the invention has been illustrated and described, as noted above, many changes can be made without departing from the spirit and scope of the invention. For example, materials besides aluminum and plastics may be used in the construction of the table unit 12. For example, wood and iron-based metals could be used. Furthermore, the ladder used to receive and mount the platform units need not be an extension latter, but can instead be a non-extension ladder. The platform may be made from two front supports 28, or two rear supports 26, to accommodate different sized ladders.

Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A portable table assembly comprising:

a plurality of table units;

said table units configured to be assembled together and mounted to and supported by a generally horizontally positioned ladder, and further comprising:

a saw stop; and a cinching strap;

wherein, the table units further comprise first and second rails;

the first rail being substantially vertical, and the second rail being substantially "L" shaped;

the rails positioned to form a corridor through which the saw stop slides and configured such that the saw stop may be secured against the rails;

the table units further comprising front and rear supports, the front and rear supports further comprising;

pairs of ladder contacting flanges;

the table units further comprising pairs of half walls, the half walls substantially "C" shaped;

the half walls forming a dowel channel;

the second rail further comprising a measuring scale;

the assembly further comprising a block and anchor configured to engage the first and second rails.

2. A device comprising:

a platform including:

holes through the platform along a first and a second opposite sides of the platform; and, attachment means along a third and a fourth opposite sides of the platform;

a forward support including:

a platform flange along a top edge of the forward support with a plurality of slots corresponding to the holes along the first side of the platform such that when the platform flange is positioned along the platform first side, a pin may be inserted through each hole along the platform first side and the corresponding slot on the platform flange; and, a first and a second support flange along a bottom edge of the forward support, the first support flange being substantially horizontal and the second support flange being substantially vertical when the forward support is operably positioned;

a rear support including:

a platform flange along a top edge of the rear support with a plurality of slots corresponding to the holes along the second side of the platform such that when the platform flange is positioned along the platform second side, a pin may be inserted through each hole along the platform second side and the corresponding slot on the platform flange; and, a first and a second support flange along a bottom edge of the rear support, the first support flange being substantially horizontal and the second support flange being substantially vertical when the rear support is operably positioned;

wherein when the front support and rear support are operably attached to the platform, the front support is more vertically oriented than the rear support.

3. The table of claim 2, wherein the attachment means comprise channels located along a bottom surface of the platform.

4. The table of claim 2, further including grooves on a top surface of the front support platform flange and the rear support platform flange, and on a bottom surface of the platform, such that the grooves may allow the front and rear supports to be securely positioned at different positions relative to the platform.

5. The table of claim 2, further including:

a saw stop;

the platform further including first and second rails, the first rail being substantially vertical and the second rail being substantially "L" shaped;

the rails positioned to form a corridor through which the saw stop slides and configured such that the saw stop may be secured against the rails.

* * * * *